US010127877B2

(12) United States Patent
Park et al.

(10) Patent No.: US 10,127,877 B2
(45) Date of Patent: Nov. 13, 2018

(54) DISPLAY DEVICE

(71) Applicant: Samsung Display Co., Ltd., Yongin-si, Gyeonggi-do (KR)

(72) Inventors: Junhyun Park, Suwon-si (KR); Sunghwan Kim, Yongin-si (KR); Seyoung Song, Hwaseong-si (KR); Kyoungju Shin, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 122 days.

(21) Appl. No.: 15/207,389

(22) Filed: Jul. 11, 2016

(65) Prior Publication Data

US 2017/0018241 A1 Jan. 19, 2017

(30) Foreign Application Priority Data

Jul. 13, 2015 (KR) ..... 10-2015-0099073

(51) Int. Cl.
*G09G 3/36* (2006.01)

(52) U.S. Cl.
CPC ..... *G09G 3/3677* (2013.01); *G09G 3/3648* (2013.01); *G09G 3/3688* (2013.01); *G09G 3/3696* (2013.01); *G09G 2310/0286* (2013.01)

(58) Field of Classification Search
CPC ..... G09G 2310/0286; G09G 3/3677; G09G 3/3696; G09G 3/3688; G09G 3/3648
See application file for complete search history.

(56) References Cited

U.S. PATENT DOCUMENTS 9,058,889 B2 6/2015 Miyake
2008/0074379 A1* 3/2008 Kim ..... G09G 3/3677 345/99
2010/0085083 A1* 4/2010 Chang ..... G09G 3/3677 327/108
2013/0335392 A1 12/2013 Cho et al.
2014/0092078 A1* 4/2014 Yoon ..... G09G 5/001 345/212
2015/0206500 A1* 7/2015 Kim ..... G09G 3/3696 345/215
2016/0203786 A1* 7/2016 Lim ..... G09G 3/20 345/211
2016/0225307 A1* 8/2016 Yoon ..... G09G 3/2092

FOREIGN PATENT DOCUMENTS

KR 10-2012-0011966 A 2/2012
KR 10-2014-0011950 A 1/2014
KR 10-2014-0098880 A 8/2014

* cited by examiner

*Primary Examiner* — Dmitry Bolotin
(74) *Attorney, Agent, or Firm* — Lewis Roca Rothgerber Christie LLP

(57) ABSTRACT

There is provided a display device including a display panel including a gate line operated by a gate signal, a clock source configured to apply a clock signal, a shift register including a stage, the stage including at least one switching element and being configured to generate the gate signal based on the clock signal applied from the clock source, and a control-voltage generator configured to generate a control voltage based on a current generated from at least one of the shift register and the clock source and to apply the control voltage to the at least one switching element.

18 Claims, 15 Drawing Sheets

DISPLAY DEVICE

CROSS-REFERENCE TO RELATED APPLICATION

This application claims priority to, and the benefit of, Korean Patent Application No. 10-2015-0099073, filed on Jul. 13, 2015, with the Korean Intellectual Property Office (KIPO), the disclosure of which is incorporated herein in its entirety by reference.

BACKGROUND

1. Field

Embodiments of the present invention relate to a display device.

2. Description of the Related Art

Liquid crystal display ("LCD") devices are a type of flat panel display ("FPD") devices that have recently found a wide range of applications. An LCD device includes two substrates including electrodes formed thereon and a liquid crystal layer interposed therebetween, and upon applying voltage to the electrodes, liquid crystal molecules in the liquid crystal layer are rearranged to adjust the amount of light transmitted therethrough.

Gate lines of a liquid crystal display ("LCD") device are operated by a shift register.

The shift register includes a plurality of switching elements. As a driving time of the shift register increases, stress imposed to gate electrodes of the switching elements increases. Due to the stress, a threshold voltage of the switching elements may progressively increase or decrease. That is, the threshold voltage of the switching elements may be shifted.

In addition, due to a process error or the like in a process of manufacturing the shift register, the threshold voltage of the switching elements may be abnormally high or low from the beginning (e.g., from the time of manufacture).

In a case where the threshold voltage of the switching elements changes, the switching elements may not be turned on normally, or an off current (leakage current) of the switching elements may increase such that the shift register may generate an abnormal output.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Aspects of embodiments of the present invention are directed to a display device capable of enhancing reliability of a shift register.

Aspects of embodiments of the present invention are directed to a display device including a shift register capable of stabilizing a threshold voltage of switching elements, thereby normally outputting signals, and significantly reducing a leakage current.

According to some exemplary embodiments of the present invention, there is provided a display device including: a display panel including a gate line operated by a gate signal; a clock source configured to apply a clock signal; a shift register including a stage, the stage including at least one switching element and being configured to generate the gate signal based on the clock signal applied from the clock source; and a control-voltage generator configured to generate a control voltage based on a current generated from at least one of the shift register and the clock source, and to apply the control voltage to the at least one switching element.

In an embodiment, the control-voltage generator is configured to adjust a level of the control voltage based on a level of the current.

In an embodiment, the control-voltage generator is configured to adjust the level of the control voltage based on a level of the current accumulated for at least a single frame period.

In an embodiment, the clock source includes: an on-voltage generator configured to generate an on voltage; and a clock generator configured to generate the clock signal based on the on voltage and the off voltage.

In an embodiment, the control-voltage generator includes: a current detector configured to detect a current between an output terminal of the on-voltage generator and an input terminal of the clock generator; and a control-voltage selector configured to select the control voltage based on a detect voltage corresponding to the current detected by the current detector and to output the selected control voltage to a sub-gate electrode of the at least one switching element.

In an embodiment, the control-voltage generator further includes an integrator configured to generate the detect voltage by integrating the current applied from the current detector over a period and to apply the detect voltage to the control-voltage selector.

In an embodiment, the control-voltage generator further includes an analog-digital converter configured to convert the detect voltage applied from the integrator into a digital signal and to apply the converted digital signal to the control-voltage selector.

In an embodiment, the at least one switching element includes: a source electrode or a drain electrode to which an off voltage that is a direct-current ("DC") voltage is applied; and a sub-gate electrode to which the control voltage is applied.

In an embodiment, the at least one switching element includes at least one selected from: a first inverter switching element including a gate electrode connected to an output terminal of the stage and a sub-gate electrode to which the control voltage is applied, the first inverter switching element being connected between an inverter node of the stage and an off-voltage input terminal of the stage; a second inverter switching element including a gate electrode connected to the output terminal of the stage and a sub-gate electrode to which the control voltage is applied, the second inverter switching element being connected between a reset node of the stage and the off-voltage input terminal of the stage; a reset switching element including a gate electrode connected to a reset control terminal of the stage and a sub-gate electrode to which the control voltage is applied, the reset switching element being connected between a set node of the stage and the off-voltage input terminal of the stage; a first output discharge switching element including a gate electrode connected to the reset node of the stage and a sub-gate electrode to which the control voltage is applied, the first output discharge switching element being connected between the output terminal of the stage and the off-voltage input terminal of the stage; and a second output discharge switching element including a gate electrode connected to the reset control terminal of the stage and a sub-gate electrode to which the control voltage is applied, the second output discharge switching element being connected between the output terminal of the stage and the off-voltage input terminal of the stage.

In an embodiment, the output terminal of the stage is one of a gate output terminal through which the gate signal is output and a carry output terminal through which a carry signal is output, and the off-voltage input terminal of the stage is one of a first off-voltage input terminal to which a first off voltage is applied and a second off-voltage input terminal to which a second off voltage is applied.

In an embodiment, the first off voltage has a level lower than that of the second off voltage, and the control voltage has a level lower than that of the first off voltage.

In an embodiment, the stage further includes an output controller configured to select one of the clock signal and the control voltage based on a select control signal and to apply the selected one of the clock signal and the control voltage to at least another switching element.

In an embodiment, the select control signal includes at least two selected from: a voltage of a set node, a voltage of a reset node, and an inverse clock signal, the inverse clock signal being an inverse of the clock signal.

In an embodiment, the output controller includes: a first control switching element including a gate electrode connected to the set node of the stage, the first control switching element being connected between a first clock input terminal of the stage and a sub-gate electrode of the at least another switching element; and a second control switching element including a gate electrode connected to one of the reset node of the stage and a second clock input terminal of the stage, the second control switching element connected between the sub-gate electrode of the at least another switching element and the first clock input terminal.

In an embodiment, the output controller further includes a third control switching element including a gate electrode connected to the reset node, the third control switching element being connected between the first control switching element and the second control switching element.

In an embodiment, the output controller further includes a fourth control switching element including a gate electrode connected to the set node, the fourth control switching element being connected between a node between the second control switching element and the third control switching element and the first clock input terminal.

In an embodiment, the output controller further includes a capacitor connected between the sub-gate electrode of the at least another switching element and a first off-voltage input terminal of the stage.

In an embodiment, the at least another switching element includes at least one selected from: a gate output switching element including a gate electrode connected to a set node of the stage and a sub-gate electrode to which the output selected by the output controller is applied, the gate output switching element being connected between a clock input terminal of the stage and a gate output terminal of the stage; a carry output switching element including a gate electrode connected to the set node and a sub-gate electrode to which the output selected by the output controller is applied, the carry output switching element being connected between the clock input terminal and a carry output terminal of the stage; and a set switching element including a gate electrode connected to a set control terminal of the stage and a sub-gate electrode to which the output selected by the output controller is applied, the set switching element being connected between the set control terminal and the set node.

The foregoing is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The above and other features and aspects of the present disclosure of invention will be more clearly understood from the following detailed description taken in conjunction with the accompanying drawings, in which.

DETAILED DESCRIPTION

Figure 1:
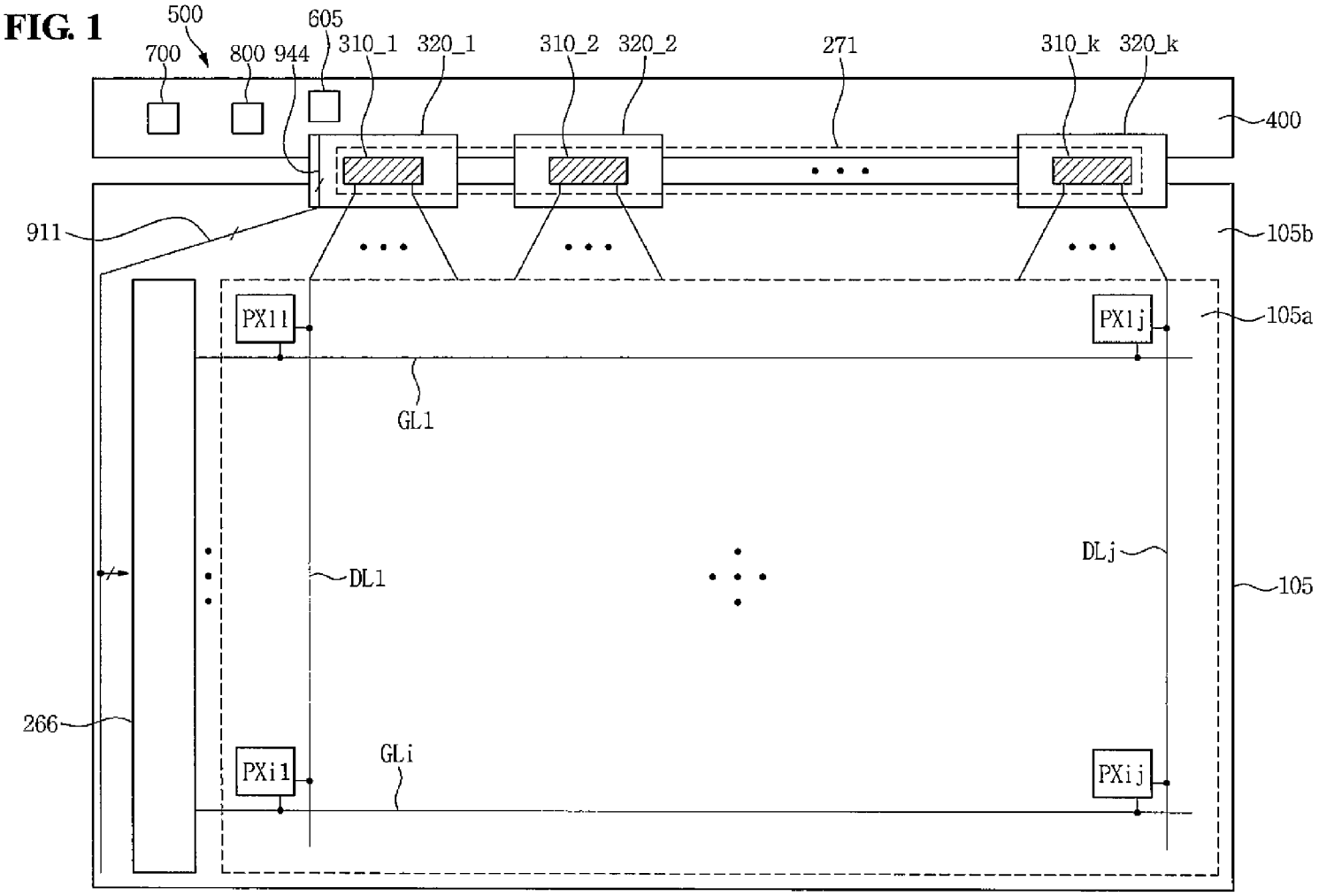
FIG. 1 is a view illustrating a display device according to an exemplary embodiment of the present invention.

Aspects and features of the present invention and methods for achieving them will be made clear from exemplary embodiments described below in detail with reference to the accompanying drawings. The present invention may, however, be embodied in many different forms and should not be construed as being limited to the exemplary embodiments set forth herein. Rather, these exemplary embodiments are provided so that this disclosure will be thorough and complete, and will fully convey the scope of the invention to those skilled in the art. The present invention is merely defined by the scope of the claims. Therefore, well-known constituent elements, operations and techniques are not described in detail in the exemplary embodiments in order to prevent the present invention from being obscurely interpreted. Like reference numerals refer to like elements throughout the specification.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

Hereinafter, a display device according to an exemplary embodiment will be described in detail with reference to FIGS. 1 to 12. Meanwhile, terminologies defining configurations used hereinbelow are merely selected for ease of description and may be differently termed in an actual product.

FIG. 1 is a view illustrating a display device 500 according to an exemplary embodiment of the present invention.

The display device 500, as illustrated in FIG. 1, includes a display panel 105, a data driver 271, a gate driver 266, a circuit board 400, a clock applying unit (e.g., a clock source) 700, and a control-voltage generating unit (a control-voltage generator) 800.

The display panel 105 is divided into a display area 105*a* and a non-display area 105*b*.

The display panel 105 may be a panel used in various suitable types of display devices, such as a liquid crystal display ("LCD") panel and an organic light emitting diode ("OLED") panel.

The display panel 105 includes a plurality of data lines DL1 to DLj, a plurality of gate lines GL1 to GLi, and a plurality of pixels PX11 to PXij. Herein, i and j are each a natural number greater than 1.

The data lines DL1 to DLj cross the gate lines GL1 to GLi. The data lines DL1 to DLj extend to the non-display area 105*b* to be connected to the data driver 271.

The data driver 271 includes a plurality of data driving integrated circuits ("ICs") 310_1, 310_2, . . . , and 310_*k*. The data driving ICs 310_1, 310_2, . . . , and 310_*k* receive digital image data signals and a data control signal from a timing controller. The data driving ICs 310_1, 310_2, . . . , and 310_*k* sample the digital image data signals according to the data control signal, latch the sampled image data signals corresponding to one horizontal line (e.g., corresponding to one of the gate lines) for each horizontal period, and apply the latched image data signals to the data lines DL1 to DLj. That is, the data driving ICs 310_1, 310_2, . . . , and 310_*k* convert the digital image data signals applied from the timing controller into analog image data signals using a gamma reference voltage input from a power supply 605 and apply the converted analog image data signals to the data lines DL1 to DLj.

The data driving ICs 310_1, 310_2, . . . , and 310_*k* are coupled to (e.g., mounted on) data carriers 320_1, 320_2, . . . , and 320_*k*, respectively. The data carriers 320_1, 320_2, . . . , and 320_*k* are connected between the circuit board 400 and the display panel 105. For example, each of the data carriers 320_1, 320_2, . . . , and 320_*k* is electrically connected between the circuit board 400 and the non-display area 105*b* of the display panel 105.

The timing controller and the power supply 605 may be disposed on the circuit board 400, and the data carriers 320_1, 320_2, . . . , and 320_*k* include input wirings configured to transmit various signals applied from the timing controller and the power supply 605 to the data driving ICs 310_1, 310_2, . . . , and 310_*k*, and output wirings configured to transmit image data signals output from the data driving ICs 310_1, 310_2, . . . , and 310_*k* to the corresponding data lines DL1 to DLj, respectively. At least one carrier 320_1 may further include auxiliary wirings 944 configured to transmit various signals applied from the timing controller and the power supply 605 to the gate driver 266, and the auxiliary wirings 944 are connected to panel wirings 911 on the display panel 105. The panel wirings 911 connect the auxiliary wirings 944 and the gate driver 266. The panel wirings 911 may be formed in the non-display area 105*b* of the display panel 105 in a line-on-glass manner.

The pixels PX11 to PXij are disposed in the display area 105*a* of the display panel 105. The pixels PX11 to PXij are arranged in a matrix form. The pixels PX11 to PXij are classified into a red pixel displaying a red image, a green pixel displaying a green pixel, and a blue pixel displaying a blue pixel. In such an embodiment, the red pixel, the green pixel, and the blue pixel that are adjacently disposed in a horizontal direction may form a unit pixel for displaying a unit image.

There are "j" number of pixels arranged along a $p^{th}$ (p is a number selected from 1 to i) horizontal line (hereinafter, $p^{th}$ horizontal line pixels) connected to the first to $j^{th}$ data lines DL1 to DLj, respectively. Further, the $p^{th}$ horizontal line pixels may be connected to the $p^{th}$ gate line together. Accordingly, the $p^{th}$ horizontal line pixels receive a $p^{th}$ gate signal as a common signal. That is, "j" number of pixels arranged in the same horizontal line receive the same gate signal, while pixels arranged in different horizontal lines receive different gate signals, respectively. Herein, "p" is a natural number greater than 1 and less than or equal to "i."

Each pixel, includes a pixel transistor, a liquid crystal capacitor, and a storage capacitor. The pixel transistor is a thin film transistor ("TFT").

The pixel transistor is turned on according to a gate signal applied from the gate line. The turned-on pixel transistor applies an analog image data signal applied from the data line to the liquid crystal capacitor and to the storage capacitor.

The liquid crystal capacitor includes a pixel electrode and a common electrode opposing each other.

The storage capacitor includes a pixel electrode and an opposing electrode opposing each other. Herein, the opposing electrode may be a previous gate line or a transmission line that transmits a common voltage.

The gate lines GL1 to GLi are operated by the gate driver 266, and the gate driver 266 includes a shift register.

The clock applying unit 700 applies clock signals. The clock applying unit 700 may be disposed on the circuit board 400.

The control-voltage generating unit 800 generates a control voltage. The control-voltage generating unit 800 may be disposed on the circuit board 400. The control-voltage generating unit 800 generates the control voltage based on current generated by at least one of the shift register and the clock applying unit 700.

The clock signals applied from (e.g., supplied from) the clock applying unit 700, the control voltage applied from (e.g., supplied from) the control-voltage generating unit 800, and off voltages applied from (e.g., supplied from) the power supply 605 are applied to the shift register of the gate driver 266 through the auxiliary wirings 944 and the panel wiring 911.

Figure 2:
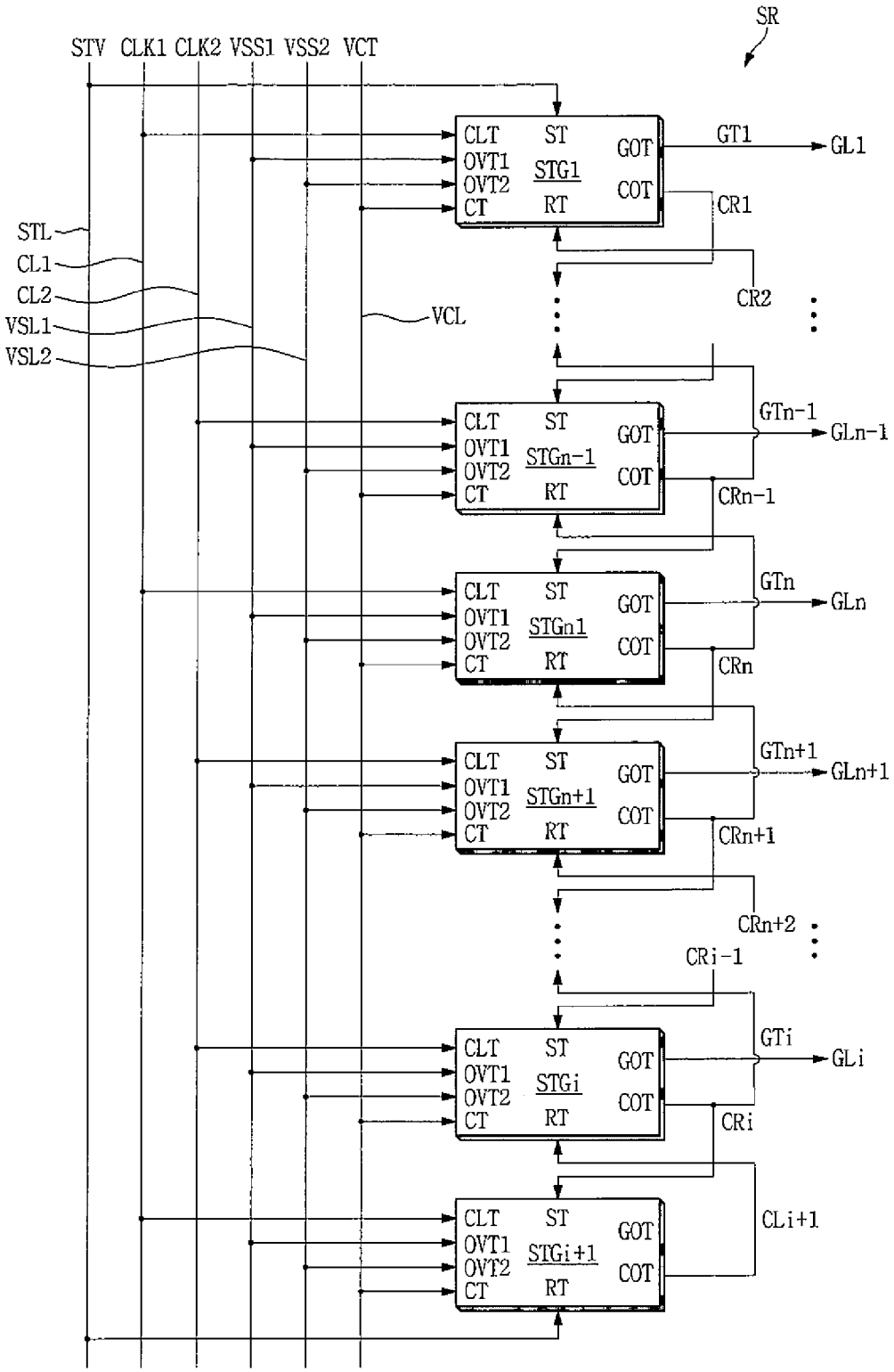
FIG. 2 is a block diagram illustrating a shift register included in a gate driver of FIG. 1.
Figure 3:
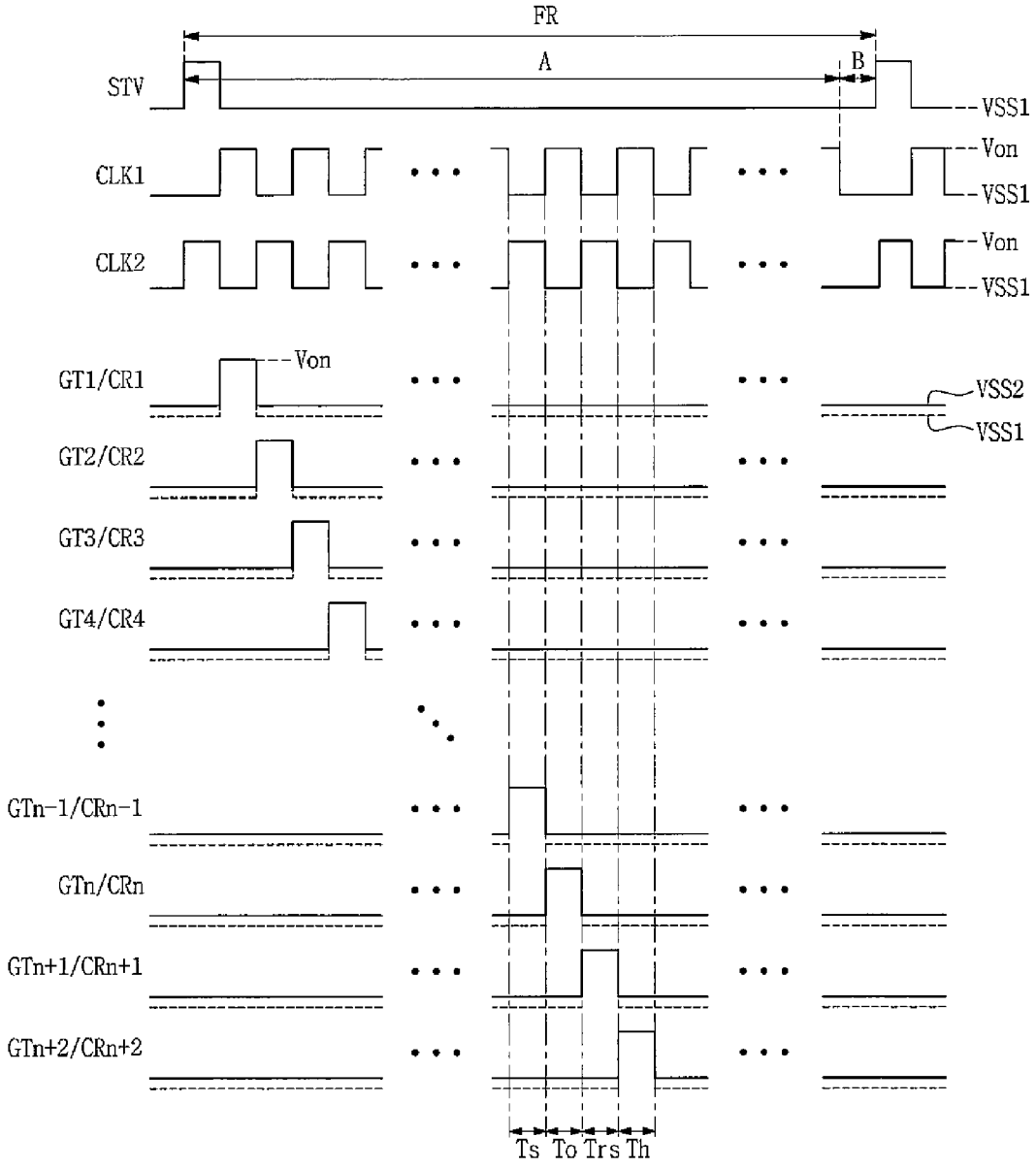
FIG. 3 is a view illustrating waveforms of various signals applied to the shift register of FIG. 2 and signals output from the shift register.

FIG. 2 is a block diagram illustrating the shift register (hereinafter, denoted by reference mark "SR") included in the gate driver 266 of FIG. 1, and FIG. 3 is a view illustrating waveforms of various signals applied to the shift register SR of FIG. 2 and signals output from the shift register SR.

The shift register SR, as illustrated in FIG. 2, includes first to $i^{th}$ stages STG1, . . . , STGn−1, STGn, STGn+1, . . . , and STGi and a dummy stage STGi+1.

The aforementioned panel wirings 911 include a vertical line STL, a first clock line CL1, a second clock line CL2, a first off line VSL1, a second off line VSL2, and a control line VCL.

The first to $i^{th}$ stages STG1 to STGi are connected to the first to $i^{th}$ gate lines GL1 to GU in a one to one correspondence. For example, as illustrated in FIG. 2, the $n^{th}$ stage STGn is connected to the $n^{th}$ gate line GLn.

The respective stages STG1 to STGi operate each corresponding one of the gate lines GL1 to GLi connected thereto. For example, the $n^{th}$ stage STGn applies an $n^{th}$ gate signal GTn to the $n^{th}$ gate line GLn to operate the $n^{th}$ gate line GLn.

The dummy stage STGi+1 outputs a dummy carry signal CRi+1 for resetting the $i^{th}$ stage STGi. Two or more dummy stages may be provided.

Each of the stages STG1 to STGi includes a set control terminal ST, a reset control terminal RT, a gate output terminal GOT, a carry output terminal COT, a clock input terminal CLT, a first off-voltage input terminal OVT1, a second off-voltage input terminal OVT2, and a control terminal CT.

The respective stages STG1 to STGi receive a set control signal through each corresponding one of the set control terminals ST. Herein, the set control signal applied to a predetermined one of the stages may be a carry signal or a gate signal output from at least one of stages that are operated prior to the predetermined one of the stages (i.e., previous stages) being operated. For example, as illustrated in FIG. 2, the $n^{th}$ stage STGn receives an $n-1^{th}$ carry signal CRn−1 output from the $n-1^{th}$ stage STGn−1. In an alternative exemplary embodiment, the set control signal may be a carry signal or a gate signal output from one of stages that are positioned further ahead of the previous stage, for example, an $n-y^{th}$ stage (where y is a natural number greater than 2 and less than "n").

The set control signal input to the first stage ST1 that is operated firstly in a single frame period FR may be a start vertical signal STV that reports the start of one frame. The start vertical signal STV may be output from at least one of the timing controller and the data driver 271.

The respective stages STG1 to STGi receive a reset control signal through each corresponding one of the reset control terminals RT. Herein, the reset control signal applied to a predetermined one of the stages may be a carry signal or a gate signal output from at least one of stages that are operated subsequently to the predetermined one of the stages (i.e., subsequent stages). For example, as illustrated in FIG. 2, the $n^{th}$ stage STGn receives an $n+1^{th}$ carry signal CRn+1 output from the $n+1^{th}$ stage STGn+1. In an alternative exemplary embodiment, the reset control signal may be a carry signal or a gate signal output from one of stages that are positioned further behind with respect to the subsequent stage, for example, an $n+z^{th}$ stage (where z is a natural number greater than 2).

The reset control signal that is applied to the $i^{th}$ stage STGi, which is operated lastly in the single frame period FR among the stages for driving the gate line, is a dummy carry signal CRi+1. The dummy carry signal CRi+1 is output from the dummy stage STGi+1. In an alternative exemplary embodiment, the start vertical signal STV may be used as the reset control signal of the last stage STGi.

The reset control signal applied to the dummy stage STGi+1 that is operated lastly in the single frame period FR may be the aforementioned start vertical signal STV. The dummy stage STGi+1 is not connected to the gate line.

The respective stages STG1 to STGi output the gate signal through each corresponding one of the gate output terminals GOT. The gate signals GT1 to GTi applied from the respective stages STG1 to STGi may be applied to the gate lines GL1 to GLi. For example, the $n^{th}$ gate signal GTn output from the $n^{th}$ stage STGn may be applied to the $n^{th}$ gate line GLn. In an example, the $n^{th}$ gate signal GTn output from the $n^{th}$ stage STGn may be applied to the $n^{th}$ gate line GLn and the $n-1^{th}$ stage STGn−1. In another example, the $n^{th}$ gate signal GTn may be applied to the $n^{th}$ gate line GLn and the $n-y^{th}$ stage. In yet another example, the $n^{th}$ gate signal GTn may be applied to the $n^{th}$ gate line GLn, the $n-1^{th}$ stage STGn−1, and the $n+1^{th}$ stage STGn+1. In yet another example, the $n^{th}$ gate signal GTn may be applied to the $n^{th}$ gate line GLn, the $n-y^{th}$ stage, and the $n+z^{th}$ stage.

The respective stages STG1 to STGi output the carry signal through each corresponding one of the carry output terminals COT. For example, the $n^{th}$ stage STGn may output an $n^{th}$ carry signal CRn through a corresponding carry output terminal COT. The $n^{th}$ carry signal CRn may be applied to the $n-1^{th}$ stage STGn−1. In an alternative exemplary embodiment, the $n^{th}$ carry signal CRn may be applied to the $n-1^{th}$ stage STGn−1 and the $n+1^{th}$ stage STGn+1. In an alternative exemplary embodiment, the $n^{th}$ carry signal CRn may be applied to the $n-y^{th}$ stage and the $n+z^{th}$ stage.

The respective stages STG1 to STGi receive the clock signal through each corresponding one of the clock input terminals CLT. For example, odd-numbered stages STG1, STGn, . . . , and STGi+1 may receive a first clock signal CLK1, and even-numbered stages . . . , STGn−1, STGn+1, STGi may receive a second clock signal (an inverse clock signal) CLK2. In an alternative exemplary embodiment, the odd-numbered stages STG1, STGn, . . . , and STGi+1 may receive the second clock signal CLK2, and the even-numbered stages . . . , STGn−1, STGn+1, STGi may receive the first clock signal CLK1. The second clock signal CLK2 has a phase shifted (inverted) by 180 degrees with respect to a phase of the first clock signal CLK1.

The first clock signal CLK1 and the second clock signal CLK2 are signals used to generate the gate signals and the carry signals of the respective stages STG1 to STGi, and the stages STG1 to STGi each receive one of the first clock signal CLK1 and the second clock signal CLK2 to output the gate signal and the carry signal. For example, the odd-numbered stages STG1, STGn, . . . , and STGi+1 use the first clock signal CLK1 to output the gate signal and the carry signal, and the even-numbered stages . . . , STGn−1, STGn+1, STGi use the second clock signal CLK2 to output the gate signal and the carry signal.

The first clock signal CLK1 is a pulse signal periodically alternating between a high voltage and a low voltage, and the high voltage of the first clock signal CLK1 has a level that may turn on the aforementioned pixel transistor and a switching element in the stage to be further described below. Likewise, the second clock signal CLK2 is a pulse signal periodically alternating between a high voltage and a low voltage, and the high voltage of the second clock signal CLK2 has a level that may turn on the aforementioned pixel transistor and the switching element in the stage to be further described below.

The low voltage of the first clock signal CLK1 has a level that may turn off the aforementioned pixel transistor and the switching element in the stage to be further described below. Likewise, the low voltage of the second clock signal CLK2 has a level that may turn off the aforementioned pixel transistor and the switching element in the stage to be further described below.

The start vertical signal STV is applied to the first stage ST1 that is operated firstly in time in the single frame period FR. The start vertical signal STV may serve to set the first stage ST1.

The start vertical signal STV is output prior to the first and second clock signals CLK1 and CLK2 being output in the single frame period FR. The first and second clock signals CLK1 and CLK2 have the high voltage a plurality of times in the single frame period FR, while the start vertical signal STV has the high voltage a single time in the single frame period FR. That is, the start vertical signal STV has a frequency lower than that of the first and second clock signals CLK1 and CLK2.

Two types of clock signals having a phase difference, that is, the first and second clock signals CLK1 and CLK2, are illustrated in FIG. 3, however, in some examples, three or more types of clock signals having a phase difference may be used.

The first and second clock signals CLK1 and CLK2 may be output to overlap each other (i.e., to be less than a 180 degrees out of phase). For example, in a case where a high period of the first clock signal CLK1 is divided into a first half period and a second half period and a high period of the second clock signal CLK2 is divided into a first half period and a second half period, the second half period of the first clock signal CLK1 and the first half period of the second clock signal CLK2 may overlap each other in time.

In addition, the start vertical signal STV may overlap one of the first clock signal CLK1 and the second clock signal CLK2. In such an embodiment, the start vertical signal STV may overlap the clock signal completely or may overlap a part of the one of the first clock signal CLK1 and the second clock signal CLK2.

The first clock signal CLK1 and the second clock signal CLK2 are applied from the clock applying unit 700. The first clock signal CLK1 output from the clock applying unit 700 may be applied to the odd-numbered stages STG1, . . . , STGn, . . . , and STGi+1 through the first clock line CL1. The second clock signal CLK2 output from the clock applying unit 700 may be applied to the even-numbered stages . . . , STGn−1, STGn+1, . . . , STGi through the second clock line CL2.

The respective stages STG1 to STGi receive a first off voltage VSS1 through each corresponding one of the first off-voltage input terminals OVT1. The first off voltage VSS1 is a direct current ("DC") voltage. The aforementioned low voltage of the first clock signal CLK1 may have a level that is the same as that of the first off voltage VSS1. Likewise, the aforementioned low voltage of the second clock signal CLK2 may have a level that is the same as that of the first off voltage VSS1.

The respective stages STG1 to STGi receive a second off voltage VSS2 through each corresponding one of the second off-voltage input terminals OVT2. The second off voltage VSS2 is a DC voltage, and may have a level greater than that of the first off voltage VSS1. For example, in a case where the first off voltage VSS1 is −14 V, the second off voltage VSS2 may be −12 V.

The first off voltage VSS1 and the second off voltage VSS2 may be applied from the power supply 605. The first off voltage VSS1 output from the power supply 605 may be applied to the entirety of the stages STG1 to STGi+1 as a common voltage through the first off line VSL1. The second off voltage VSS2 output from the power supply 605 may be applied to the entirety of the stages STG1 to STGi+1 as a common voltage through the second off line VSL2.

The respective stages STG1 to STGi receive the control voltage VCT through each corresponding one of the control terminals CT. The control voltage VCT is applied from the control-voltage generating unit 800. The control voltage VCT output from the control-voltage generating unit 800 is applied to at least one stage through the control line VCL. For example, as illustrated in FIG. 2, the control voltage VCT may be applied to the entirety of the stages STG1 to STGi+1.

The dummy stage STGi+1 has the same or substantially the same configuration as the configuration of one of the aforementioned stages. However, the dummy stage STGi+1, as illustrated in FIG. 2, may not include the gate output terminal GOT.

The stages STG1 to STGi and the dummy stage STGi+1 having such a configuration sequentially output the gate signals GT1 to GTi and the carry signals CR1 to CRi from the first stage STG1 to the $i^{th}$ stage STGi. Subsequent to the last gate signal GTi and the last carry signal CRi being generated from the $i^{th}$ stage STGi, the dummy stage STGi+1 outputs the dummy carry signal CRi+1. The dummy carry signal CRi+1 is only applied to the $i^{th}$ stage STGi.

In FIG. 3, the first to $n+2^{th}$ gate signals GT1 to GTn+2 are represented by solid lines, and the first to $n+2^{th}$ carry signals CR1 to CRn+2 are represented by dashed lines.

Figure 4:
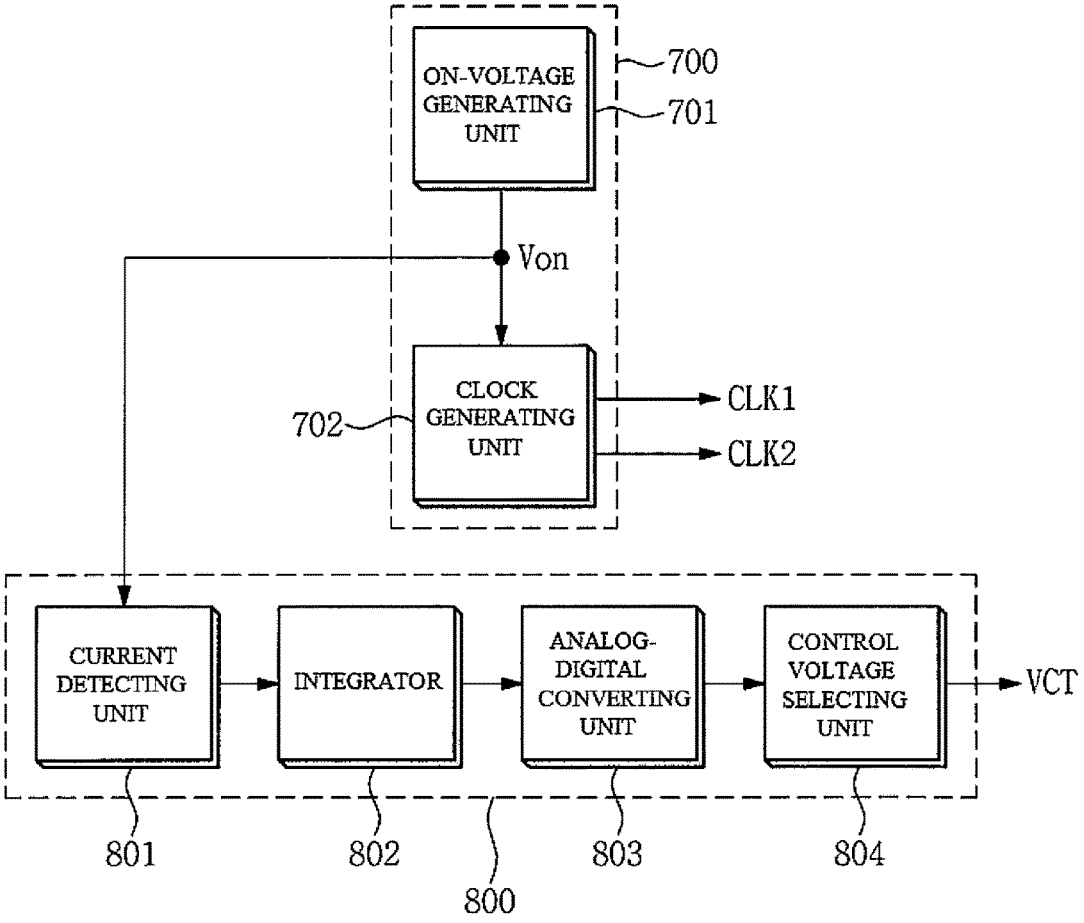
FIG. 4 is a block diagram illustrating a clock applying unit and a control-voltage generating unit of FIG. 1.

FIG. 4 is a block diagram illustrating the clock applying unit 700 and the control-voltage generating unit 800 of FIG. 1.

The clock applying unit 700 may generate clock signals that are the same or substantially the same as those illustrated in FIG. 3. The clock applying unit 700, as illustrated in FIG. 4, includes an on-voltage generating unit (e.g., an on-voltage generator) 701 and a clock generating unit (e.g., a clock generator) 702.

The on-voltage generating unit 701 generates an on voltage Von. The on voltage Von is a DC voltage. The on voltage Von corresponds to the high voltage of the first clock signal CLK1 and the high voltage of the second clock signal CLK2.

The clock generating unit 702 receives the on voltage Von from the on-voltage generating unit 701, and switches the on voltage Von so as to generate the first clock signal CLK1 and the second clock signal CLK2. For example, the clock generating unit 702 may output the first off voltage VSS1 applied from the power supply 605 and the aforementioned on voltage Von alternately to thereby generate the first clock signal CLK1 and the second clock signal CLK2. To this end, the clock generating unit 702 may include switching elements that may switch the first off voltage VSS1 and the on voltage Von to output the switched voltage.

The control-voltage generating unit 800 generates the control voltage VCT based on current generated by at least one of the shift register SR and the clock applying unit 700. The control-voltage generating unit 800 adjusts the level of the control voltage VCT based on the level of the current. To this end, the control-voltage generating unit 800 may include a current detecting unit (e.g., a current detector) 801, an integrator 802, an analog-digital converting unit (e.g., an analog-digital converter) 803, and a control-voltage selecting unit (e.g., a control-voltage selector) 804.

The current detecting unit 801 detects a current (hereinafter, "first current") between an output terminal of the on-voltage generating unit 701 and an input terminal of the clock generating unit 702. A current (hereinafter, "second current") consumed by the shift register SR includes an off current of the switching element, which is a leakage current. A variation in the level of the second current is proportional to an amount of the leakage current. The variation in the amount of the second current affects the variation in the amount of the aforementioned first current. Accordingly, the variation in the amount of the first current corresponds to (e.g., is proportional or equal to) the variation in the amount of the second current. The current detecting unit 801 may indirectly verify the amount of variation in the current consumed by the shift register SR by detecting the amount of variation in the first current. In some examples, the current detecting unit 801 may directly detect the second current. Thus, the current detecting unit 801 may be connected to at least one of the first clock line CL1 and the second clock line CL2 to detect an amount of variation in the current thereof. The current detecting unit 801 may include a current mirror.

The integrator 802 integrates the current applied from the current detecting unit 801 over a predetermined period to thereby generate a detect voltage. The period, for example, may be an active period (A) of the single frame period FR. A single frame period FR, as illustrated in FIG. 3, is divided into the active period (A) and a blank period (B). The active period (A) is a period in which the start vertical signal STV, the first clock signal CLK1, and the second clock signal CLK2 are normally output, and the blank period (B) is a period in which various signals required for a next frame period are set. However, an image data signal required for displaying an image is not included in the aforementioned various signals. That is, the image data signal is not generated in the blank period (B). The integrator 802 integrates the current over the active period (A) to generate the detect voltage.

The analog-digital converting unit 803 is configured to convert the detect voltage applied from the integrator 802 to a digital signal.

The control-voltage selecting unit 804 receives the detect voltage from the analog-digital converting unit 803, and selects a control voltage VCT corresponding to the detect voltage. To this end, the control-voltage selecting unit 804 may include a lookup table. A plurality of control voltages VCT corresponding to the level of the detect voltage are stored in the lookup table. The control-voltage selecting unit 804 selects the control voltage VCT corresponding to the detect voltage from the lookup table based on the level of the detect voltage, and outputs the selected control voltage VCT. The control-voltage selecting unit 804 may output the selected control voltage VCT in the aforementioned blank period (B). The control voltage VCT output from the control-voltage selecting unit 804 is applied to at least one switching element of the shift register SR. In such an embodiment, the control voltage VCT is applied to a sub-gate electrode of the switching element.

The plurality of control voltages VCT stored in the lookup table have different levels from one another. In such an embodiment, each of the plurality of control voltages VCT is a DC voltage, and has a level lower than the off voltage having a smallest level. For example, each of the plurality of control voltages VCT has a level lower than the level of the aforementioned first off voltage VSS1. In more detail, in a case where one of the plurality of control voltages VCT has a level of −19 V, the other of the control voltages VCT may have voltages lower than −19 V and different from one another. For example, one of the other control voltages VCT may have a level of −24 V.

Thus, it is appreciated that an amount of current leaking from the shift register SR increases in accordance with an increase in the detect voltage, and accordingly, a lower level of the control voltage VCT is selected in accordance with an increase in the detect voltage. Further, as a voltage difference between the control voltage VCT applied to the sub-gate electrode of the switching element and the voltage applied to a source electrode of the switching element decreases (i.e., a sub-gate-source voltage of the switching element decreases), a threshold voltage of the switching element increases. As the threshold voltages of the switching element increases, the leakage current of the switching element decreases.

Hereinafter, the configuration of the stage will be described. Herein, the configurations of the first to $i+1^{th}$ stages are substantially the same as one another, and thus the $n^{th}$ stage STGn will be representatively described.

Figure 5:
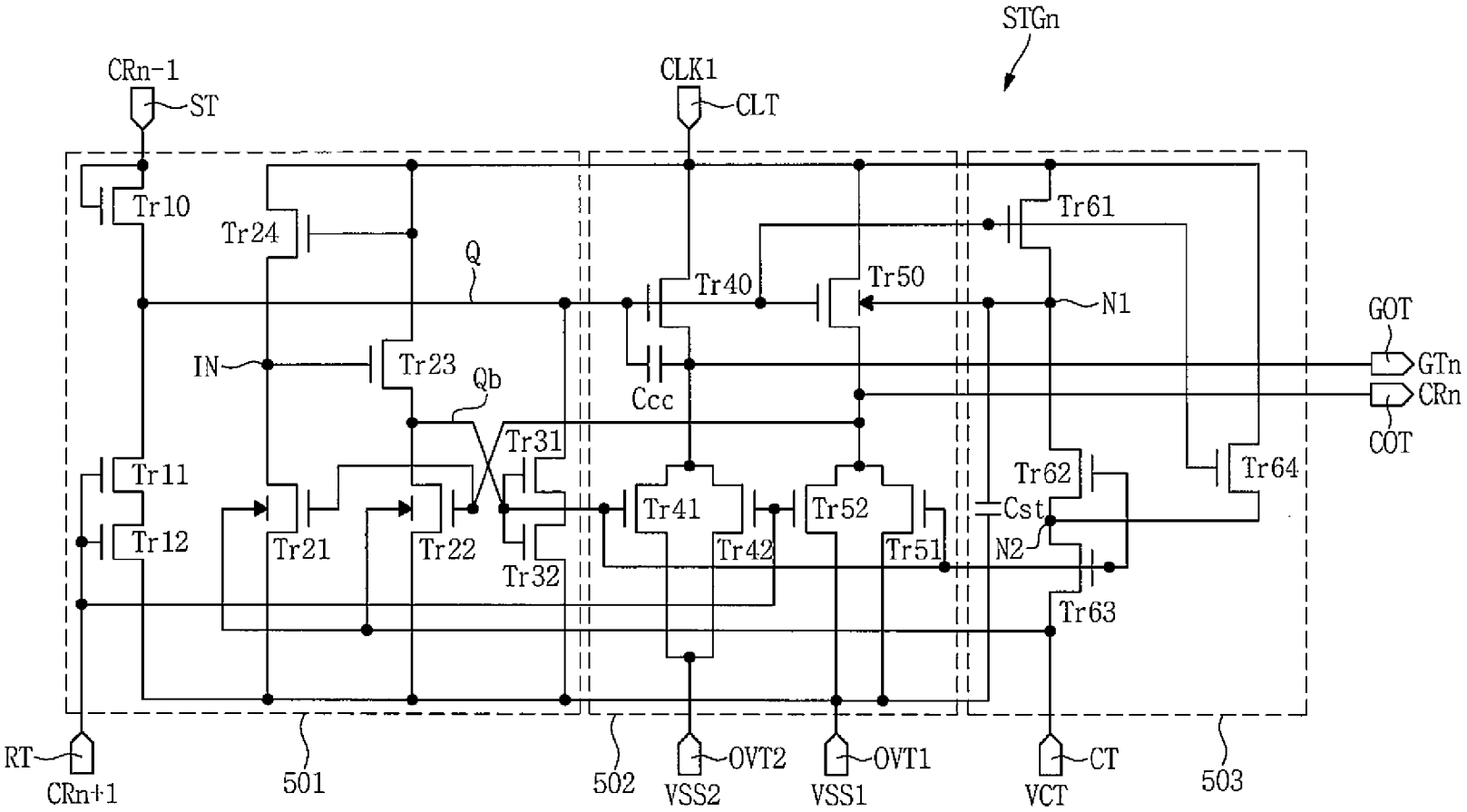
FIG. 5 is a detailed configuration view illustrating an $n^{th}$ stage of FIG. 2.

FIG. 5 is a detailed configuration view illustrating an $n^{th}$ stage STGn of FIG. 2.

The $n^{th}$ stage STGn, as illustrated in FIG. 5, includes a node control unit (e.g., a node controller) 501, an output unit (e.g., an output circuit) 502, and an output control unit (e.g., an output controller) 503.

The node control unit 501 of the $n^{th}$ stage STGn controls a set node Q and a reset node Qb of the $n^{th}$ stage STGn. The node control unit 501 of the $n^{th}$ stage STGn includes a set switching element Tr10, a first reset switching element Tr11, a second reset switching element Tr12, a first inverter switching element Tr21, a second inverter switching element Tr22, a third inverter switching element Tr23, a fourth inverter switching element Tr24, a first set discharge switching element Tr31, and a second set discharge switching element Tr32.

The set switching element Tr10 of the $n^{th}$ stage STGn charges the set node Q of the $n^{th}$ stage STGn based on the set control signal. The set control signal may be the $n-1^{th}$ carry signal CRn−1 applied from the $n-1^{th}$ stage STGn−1. The set switching element Tr10 of the $n^{th}$ stage STGn is turned on or turned off by the $n-1^{th}$ carry signal CRn−1, and when turned on, the set switching element Tr10 electrically connects the set control terminal ST of the $n^{th}$ stage STGn and the set node Q of the $n^{th}$ stage STGn. To this end, the set switching element Tr10 includes a gate electrode connected to the set control terminal ST, and is connected between the set control terminal ST and the set node Q.

The first reset switching element Tr11 of the $n^{th}$ stage STGn discharges the set node Q of the $n^{th}$ stage STGn based on the reset control signal. The reset control signal may be the $n+1^{th}$ carry signal CRn+1 applied from the $n+1^{th}$ stage STGn+1. The first reset switching element Tr11 of the $n^{th}$ stage STGn is turned on or turned off by the $n+1^{th}$ carry signal CRn+1, and when turned on, the first reset switching element Tr11 electrically connects the set node Q of the $n^{th}$ stage STGn and the second reset switching element Tr12 of the $n^{th}$ stage STGn. To this end, the first reset switching element Tr11 includes a gate electrode connected to the reset control terminal RT, and is connected between the set node Q and the second reset switching element Tr12.

The second reset switching element Tr12 of the $n^{th}$ stage STGn discharges the set node Q of the $n^{th}$ stage STGn based on the reset control signal. The reset control signal may be the $n+1^{th}$ carry signal CRn+1 applied from the $n+1^{th}$ stage STGn+1. The second reset switching element Tr12 of the $n^{th}$ stage STGn is turned on or turned off by the $n+1^{th}$ carry signal CRn+1, and when turned on, the second reset switching element Tr12 electrically connects the first reset switching element Tr11 of the $n^{th}$ stage STGn and the first off-voltage input terminal OVT1 of the $n^{th}$ stage STGn. To this end, the second reset switching element Tr12 includes a gate electrode connected to the reset control terminal RT, and is connected between the first reset switching element Tr11 and the first off-voltage input terminal OVT1.

The first inverter switching element Tr21 of the $n^{th}$ stage STGn discharges the inverter node IN of the $n^{th}$ stage STGn based on the $n^{th}$ carry signal CRn applied to the carry output terminal COT of the $n^{th}$ stage STGn and the control voltage VCT applied to the control terminal CT of the $n^{th}$ stage STGn. The first inverter switching element Tr21 of the $n^{th}$ stage STGn is turned on or turned off by the $n^{th}$ carry signal CRn and the control voltage VCT, and when turned on, the first inverter switching element Tr21 electrically connects the inverter node IN and the first off-voltage input terminal OVT1 of the $n^{th}$ stage STGn. To this end, the first inverter switching element Tr21 includes a gate electrode connected to the carry output terminal COT and a sub-gate electrode connected to the control terminal CT, and is connected between the inverter node IN and the first off-voltage input terminal OVT1. The first inverter switching element Tr21 of the $n^{th}$ stage STGn may receive the $n^{th}$ gate signal GTn applied to the gate output terminal GOT of the $n^{th}$ stage STGn rather than the aforementioned $n^{th}$ carry signal CRn.

The second inverter switching element Tr22 of the $n^{th}$ stage STGn discharges the reset node Qb of the $n^{th}$ stage STGn based on the $n^{th}$ carry signal CRn applied to the carry output terminal COT of the $n^{th}$ stage STGn and the control voltage VCT applied to the control terminal CT of the $n^{th}$ stage STGn. The second inverter switching element Tr22 of the $n^{th}$ stage STGn is turned on or turned off by the $n^{th}$ carry signal CRn and the control voltage VCT, and when turned on, the second inverter switching element Tr22 electrically connects the reset node Qb and the first off-voltage input terminal OVT1. To this end, the second inverter switching element Tr22 includes a gate electrode connected to the carry output terminal COT and a sub-gate electrode connected to the control terminal CT, and is connected between the reset node Qb and the first off-voltage input terminal OVT1. The second inverter switching element Tr22 of the $n^{th}$ stage STGn may receive the $n^{th}$ gate signal GTn applied to the gate output terminal GOT of the $n^{th}$ stage STGn, rather than the $n^{th}$ carry signal CRn.

The third inverter switching element Tr23 of the $n^{th}$ stage STGn charges or discharges the reset node Qb of the $n^{th}$ stage STGn based on the signal applied to the inverter node IN of the $n^{th}$ stage STGn. The third inverter switching element Tr23 of the $n^{th}$ stage STGn is turned on or turned off by a signal applied to the inverter node IN, and when turned on, the third inverter switching element Tr23 electrically connects the clock input terminal CLT and the reset node Qb of the $n^{th}$ stage STGn. To this end, the third inverter switching element Tr23 includes a gate electrode connected to the inverter node IN, and is connected between the clock input terminal CLT and the reset node Qb.

The fourth inverter switching element Tr24 of the $n^{th}$ stage STGn charges the inverter node IN of the $n^{th}$ stage STGn based on the first clock signal CLK1 applied to the clock input terminal CLT of the $n^{th}$ stage STGn. The fourth inverter switching element Tr24 of the $n^{th}$ stage STGn is turned on or turned off by the first clock signal CLK1, and when turned on, the fourth inverter switching element Tr24 electrically connects the clock input terminal CLT and the inverter node IN. To this end, the fourth inverter switching element Tr24 includes a gate electrode connected to the clock input terminal CLT, and is connected between the clock input terminal CLT and the inverter node IN.

The first set discharge switching element Tr31 of the $n^{th}$ stage STGn discharges the set node Q of the $n^{th}$ stage STGn based on a signal applied to the reset node Qb of the $n^{th}$ stage STGn. The first set discharge switching element Tr31 of the $n^{th}$ stage STGn is turned on or turned off by the signal applied to the reset node Qb, and when turned on, the first set discharge switching element Tr31 electrically connects the set node Q of the $n^{th}$ stage STGn and the second set discharge switching element Tr32 of the $n^{th}$ stage STGn. To this end, the first set discharge switching element Tr31 includes a gate electrode connected to the reset node Qb, and is connected between the set node Q and the second set discharge switching element Tr32.

The second set discharge switching element Tr32 of the $n^{th}$ stage STGn discharges the set node Q of the $n^{th}$ stage STGn based on the signal applied to the reset node Qb of the $n^{th}$ stage STGn. The second set discharge switching element Tr32 of the $n^{th}$ stage STGn is turned on or turned off by the signal applied to the reset node Qb, and when turned on, the second discharge switching element Tr32 electrically connects the first set discharge switching element Tr31 and the first off-voltage input terminal OVT1 of the $n^{th}$ stage STGn. To this end, the second set discharge switching element Tr32 includes a gate electrode connected to the reset node Qb, and is connected between the first set discharge switching element Tr31 and the first off-voltage input terminal OVT1.

The output unit 502 of the $n^{th}$ stage STGn outputs the gate signal and the carry signal based on a signal applied to the set node Q of the nth stage STGn and the signal applied to the reset node Qb of the $n^{th}$ stage STGn. The output unit 502 of the $n^{th}$ stage STGn includes a gate output switching element Tr40, a carry output switching element Tr50, first output discharge switching elements Tr41 and Tr51, second output discharge switching elements Tr42 and Tr52, and a coupling capacitor Ccc. Herein, the first output discharge switching element includes the first gate discharge switching element Tr41 and the first carry discharge switching element Tr51, and the second output discharge switching element includes the second gate discharge switching element Tr42 and the second carry discharge switching element Tr52.

The gate output switching element Tr40 of the $n^{th}$ stage STGn outputs the first clock signal CLK1 as the $n^{th}$ gate signal GTn based on the signal of the set node Q of the $n^{th}$ stage STGn. The gate output switching element Tr40 of the $n^{th}$ stage STGn is turned on or turned off by the signal of the set node Q, and when turned on, the gate output switching element Tr40 electrically connects the clock input terminal CLT of the $n^{th}$ stage STGn and the gate output terminal GOT of the $n^{th}$ stage STGn. To this end, the gate output switching element Tr40 includes a gate electrode connected to the set node Q, and is connected between the clock input terminal CLT and the gate output terminal GOT.

The carry output switching element Tr50 of the $n^{th}$ stage STGn outputs the first clock signal CLK1 as the $n^{th}$ carry signal CRn based on the signal of the set node Q of the $n^{th}$ stage STGn and the output of the output control unit 503 of the $n^{th}$ stage STGn. The carry output switching element Tr50 of the $n^{th}$ stage STGn is turned on or turned off by the signal of the set node Q and the output of the output control unit 503, and when turned on, the carry output switching element Tr50 electrically connects the clock input terminal CLT of the $n^{th}$ stage STGn and the carry output terminal COT of the $n^{th}$ stage STGn. To this end, the carry output switching element Tr50 includes a gate electrode connected to the set node Q, a sub-gate electrode connected to an output terminal N1 of the output control unit 503, and is connected between the clock input terminal CLT and the carry output terminal COT. The output control unit 503 generates an output through the output terminal N1 thereof.

The first gate discharge switching element Tr41 of the $n^{th}$ stage STGn discharges the gate output terminal GOT of the $n^{th}$ stage STGn based on the signal applied to the reset node Qb of the $n^{th}$ stage STGn. The first gate discharge switching element Tr41 of the $n^{th}$ stage STGn is turned on or turned off by the signal applied to the gate output terminal GOT, and when turned on, the first gate discharge switching element Tr41 electrically connects the gate output terminal GOT and the second off-voltage input terminal OVT2 of the $n^{th}$ stage STGn. To this end, the first gate discharge switching element Tr41 includes a gate electrode connected to the reset node Qb, and is connected between the gate output terminal GOT and the second off-voltage input terminal OVT2. The first gate discharge switching element Tr41 may receive the first off voltage VSS1 rather than the second off voltage VSS2.

The second gate discharge switching element Tr42 of the $n^{th}$ stage STGn discharges the gate output terminal GOT of the $n^{th}$ stage STGn based on the reset control signal. The reset control signal may be the $n+1^{th}$ carry signal CRn+1 applied from the $n+1^{th}$ stage STGn+1. The second gate discharge switching element Tr42 of the $n^{th}$ stage STGn is turned on or turned off by the $n+1^{th}$ carry signal CRn+1, and when turned on, the second gate discharge switching element Tr42 electrically connects the gate output terminal GOT and the second off-voltage input terminal OVT2 of the $n^{th}$ stage STGn. To this end, the second gate discharge switching element Tr42 includes a gate electrode connected to the reset control terminal RT of the $n^{th}$ stage STGn, and is connected between the gate output terminal GOT and the second off-voltage input terminal OVT2. The second gate discharge switching element Tr42 may receive the first off voltage VSS1 rather than the second off voltage VSS2.

The first carry discharge switching element Tr51 of the $n^{th}$ stage STGn discharges the carry output terminal COT of the $n^{th}$ stage STGn based on the signal applied to the reset node Qb of the $n^{th}$ stage STGn. The first carry discharge switching element Tr51 of the $n^{th}$ stage STGn is turned on or turned off by the signal applied to the reset node Qb, and when turned on, the first carry discharge switching element Tr51 electrically connects the carry output terminal COT and the first off-voltage input terminal OVT1 of the $n^{th}$ stage STGn. To this end, the first carry discharge switching element Tr51 includes a gate electrode connected to the reset node Qb, and is connected between the carry output terminal COT and the first off-voltage input terminal OVT1. The first carry discharge switching element Tr51 may receive the second off voltage VSS2 rather than the first off voltage VSS1.

The second carry discharge switching element Tr52 of the $n^{th}$ stage STGn discharges the carry output terminal COT of the $n^{th}$ stage STGn based on the reset control signal. The reset control signal may be the $n+1^{th}$ carry signal CRn+1 applied from the $n+1^{th}$ stage STGn+1. The second carry discharge switching element Tr52 of the $n^{th}$ stage STGn is turned on or turned off by the $n+1^{th}$ carry signal CRn+1, and when turned on, the second carry discharge switching element Tr52 electrically connects the carry output terminal COT and the first off-voltage input terminal OVT1 of the $n^{th}$ stage STGn. To this end, the second carry discharge switching element Tr52 includes a gate electrode connected to the reset control terminal RT of the $n^{th}$ stage STGn, and is connected between the carry output terminal COT and the first off-voltage input terminal OVT1. The second carry discharge switching element Tr52 may receive the second off voltage VSS2 rather than the first off voltage VSS1.

The coupling capacitor Ccc of the $n^{th}$ stage STGn is connected between the set node Q of the $n^{th}$ stage STGn and the gate output terminal GOT of the $n^{th}$ stage STGn. The coupling capacitor Ccc may be substituted with a parasitic capacitor between the gate electrode of the gate output switching element Tr40 and a source electrode thereof. Herein, the source electrode of the gate output switching element Tr40 corresponds to the gate output terminal GOT of the $n^{th}$ stage STGn.

The output control unit 503 of the $n^{th}$ stage STGn selects one of the first clock signal CLK1 and the control voltage VCT based on the select control signal. The select control signal includes at least two selected from: the voltage of the set node Q included in the $n^{th}$ stage STGn, the voltage of the reset node Qb included in the $n^{th}$ stage STGn, and the second clock signal CLK2. For example, the select control signal may include the voltage of the set node Q and the voltage of the reset node Qb. In an alternative example, the select control signal may include the voltage of the set node Q and the second clock signal CLK2.

The output control unit 503 of the $n^{th}$ stage STGn includes a first control switching element Tr61, a second control switching element Tr62, a third control switching element Tr63, a fourth control switching element Tr64, and a storage capacitor Cst.

The first control switching element Tr61 of the $n^{th}$ stage STGn applies the first clock signal CLK1 to a sub-gate electrode of the carry output switching element Tr50 provided in the $n^{th}$ stage STGn based on the signal of the set node Q provided in the $n^{th}$ stage STGn. The first control switching element Tr61 of the $n^{th}$ stage STGn is turned on or turned off by the signal of the set node Q, and when turned on, the first control switching element Tr61 electrically connects the clock input terminal CLT of the $n^{th}$ stage STGn and the sub-gate electrode of the carry output switching element Tr50 of the $n^{th}$ stage STGn. To this end, the first control switching element Tr61 includes a gate electrode connected to the set node Q, and is connected between the clock input terminal CLT and the sub-gate electrode of the carry output switching element Tr50.

The second control switching element Tr62 of the $n^{th}$ stage STGn applies the control voltage VCT to the sub-gate electrode of the carry output switching element Tr50 provided in the $n^{th}$ stage STGn based on the signal of the reset node Qb provided in the $n^{th}$ stage STGn. The second control switching element Tr62 of the $n^{th}$ stage STGn is turned on or turned off by the signal of the reset node Qb, and when turned on, the second control switching element Tr62 electrically connects the sub-gate electrode of the carry output switching element Tr50 and the third control switching element Tr63 of the $n^{th}$ stage STGn. To this end, the second control switching element Tr62 includes a gate electrode connected to the reset node Qb, and is connected between the sub-gate electrode of the carry output switching element Tr50 and the third control switching element Tr63.

The third control switching element Tr63 of the $n^{th}$ stage STGn applies the control voltage VCT to the sub-gate electrode of the carry output switching element Tr50 provided in the $n^{th}$ stage STGn based on the signal of the reset node Qb provided in the $n^{th}$ stage STGn. The third control switching element Tr63 of the $n^{th}$ stage STGn is turned on or turned off by the signal of the reset node Qb, and when turned on, the third control switching element Tr63 electrically connects the second control switching element Tr62 of the $n^{th}$ stage STGn and the control terminal CT of the $n^{th}$ stage STGn. To this end, the third control switching element Tr63 includes a gate electrode connected to the reset node Qb, and is connected between the second control switching element Tr62 and the control terminal CT.

The fourth control switching element Tr64 of the $n^{th}$ stage STGn applies the first clock signal CLK1 to a contact point N2 (hereinafter, "feedback node") between the second control switching element Tr62 and the third control switching element Tr63 provided in the $n^{th}$ stage STGn based on the signal of the set node Q provided in the $n^{th}$ stage STGn. The fourth control switching element Tr64 of the $n^{th}$ stage STGn is turned on or turned off by the signal of the set node Q, and when turned on, the fourth control switching element Tr64 electrically connects the clock input terminal CLT of the $n^{th}$ stage STGn and the aforementioned feedback node N2 of the $n^{th}$ stage STGn. To this end, the fourth control switching element Tr64 includes a gate electrode connected to the set node Q, and is connected between the clock input terminal CLT and the feedback node N2.

The storage capacitor Cst of the $n^{th}$ stage STGn is connected between the sub-gate electrode of the carry output switching element Tr50 provided in the $n^{th}$ stage STGn and the first off-voltage input terminal OVT1 of the $n^{th}$ stage STGn. The storage capacitor Cst may be connected to the second off-voltage input terminal OVT2 rather than the first off-voltage input terminal OVT1.

The operation of the $n^{th}$ stage STGn will be described in detail with reference to FIGS. 3, and 6A to 6D.

FIGS. 6A to 6D are views illustrating operations of respective periods in the $n^{th}$ stage STGn according to an exemplary embodiment of the present invention. In FIGS. 6A to 6D, a switching element surrounded by a circular dashed line is a switching element in a turned-on state, and the other switching elements except for the switching element surrounded by the circular dashed line are switching elements in a turned-off state.

1) Set Period (Ts)

Figure 6A:
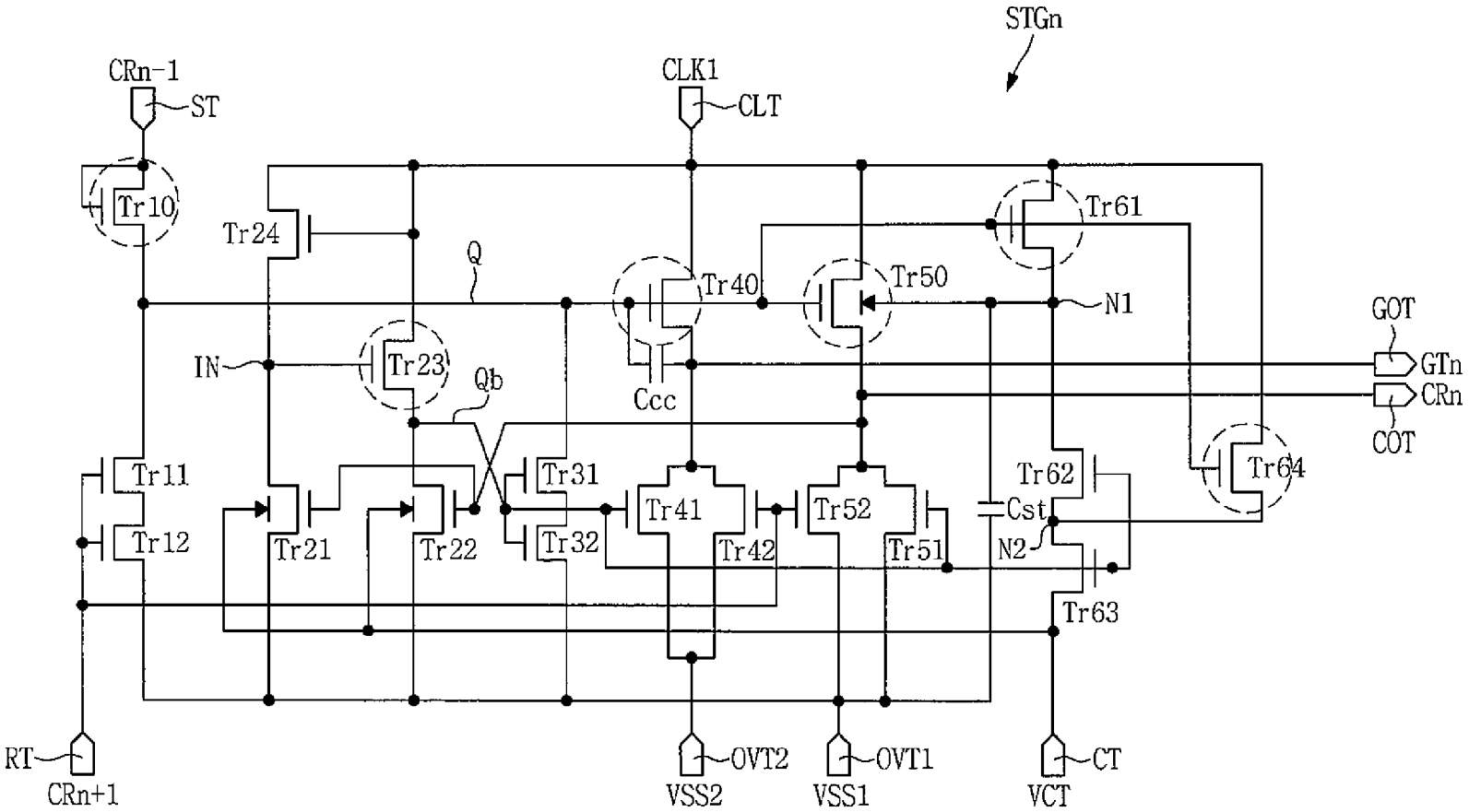
FIGS. 6A-6D are views illustrating operations of respective periods in the $n^{th}$ stage according to an exemplary embodiment of the present invention.

Firstly, the operation of the $n^{th}$ stage STGn in a set period Ts of the $n^{th}$ stage STGn will be described with reference to FIGS. 3 and 6A.

In the set period Ts of the $n^{th}$ stage STGn, as illustrated in FIG. 3, the first clock signal CLK1 maintains a low voltage level corresponding to the first off voltage VSS1, the second clock signal CLK2 maintains a high voltage level corresponding to the on voltage Von, and the $n-1^{th}$ gate signal GTn−1 and the $n-1^{th}$ carry signal CRn−1 applied from the $n-1^{th}$ stage STGn−1 each maintain a high voltage level corresponding to the on voltage Von.

The $n-1^{th}$ carry signal CRn−1 having a high voltage level output from the $n-1^{th}$ stage STGn−1 is applied to the gate electrode of the set switching element Tr10 provided in the $n^{th}$ stage STGn. Then, the set switching element Tr10 of the $n^{th}$ stage STGn is turned on, and through the turned-on set switching element Tr10, the $n-1^{th}$ carry signal CRn−1 having a high voltage level is applied to the set node Q of the $n^{th}$ stage STGn. Accordingly, the set node Q is charged, and the gate output switching element Tr40, the carry output switching element Tr50, the first control switching element Tr61, and the fourth control switching element Tr64 of the $n^{th}$ stage STGn, that are connected to the charged set node Q through the respective gate electrodes, are turned on.

Through the turned-on gate output switching element Tr40, the first clock signal CLK1 having a low voltage level is applied to the gate output terminal GOT of the $n^{th}$ stage STGn.

Through the turned-on carry output switching element Tr50, the first clock signal CLK1 having a low voltage level is applied to the carry output terminal COT of the nth stage STGn.

Through the turned-on first control switching element Tr61, the first clock signal CLK1 having a low voltage level is applied to the sub-gate electrode of the carry output switching element Tr50.

Through the turned-on fourth control switching element Tr64, the first clock signal CLK1 having a low voltage level is applied to the feedback node N2.

The first inverter switching element Tr21 and the second inverter switching element Tr22 receiving the $n^{th}$ carry signal CRn having a low voltage level through the respective gate electrodes are each turned off.

The fourth inverter switching element Tr24 receiving the first clock signal CLK1 having a low voltage level through the gate electrode is turned off.

In the set period Ts, the inverter node IN of the $n^{th}$ stage STGn is charged with the first clock signal CLK1 having a high voltage level that is applied prior to the set period Ts, and the third inverter switching element Tr23 connected to the charged inverter node IN through the gate electrode is in a turned-on state. Through the turned-on third inverter switching element Tr23, the first clock signal CLK1 having a low voltage level is applied to the reset node Qb of the $n^{th}$ stage STGn. Accordingly, the reset node Qb is discharged, and the first set discharge switching element Tr31, the second set discharge switching element Tr32, the first gate discharge switching element Tr41, the first carry discharge switching element Tr51, the second control switching element Tr62, and the third control switching element Tr63 connected to the discharged reset node Qb through the respective gate electrodes are turned off.

As illustrated in FIG. 3, as the $n+1^{th}$ carry signal CRn+1 maintains a low voltage level in the set period Ts, the first reset switching element Tr11, the second reset switching element Tr12, the second gate discharge switching element Tr42, and the second carry discharge switching element Tr52 that receive the $n+1^{th}$ carry signal CRn+1 having a low voltage level through the respective gate electrodes are turned off. In such an embodiment, as the first reset switching element Tr11 and the second reset switching element Tr12 are connected in series between the set node Q and the first off-voltage input terminal OVT1, and current leaking from the set node Q to the first off-voltage input terminal OVT1 decreases. In other words, a leakage current of the first reset switching element Tr11 and the second reset switching element Tr12 decreases.

As such, while the set node Q is charged with a high voltage in the set period Ts of the $n^{th}$ stage STGn, the reset node Qb is discharged to the low voltage, and thereby the $n^{th}$ stage STGn is set.

2) Output Period (To)

Figure 6B:
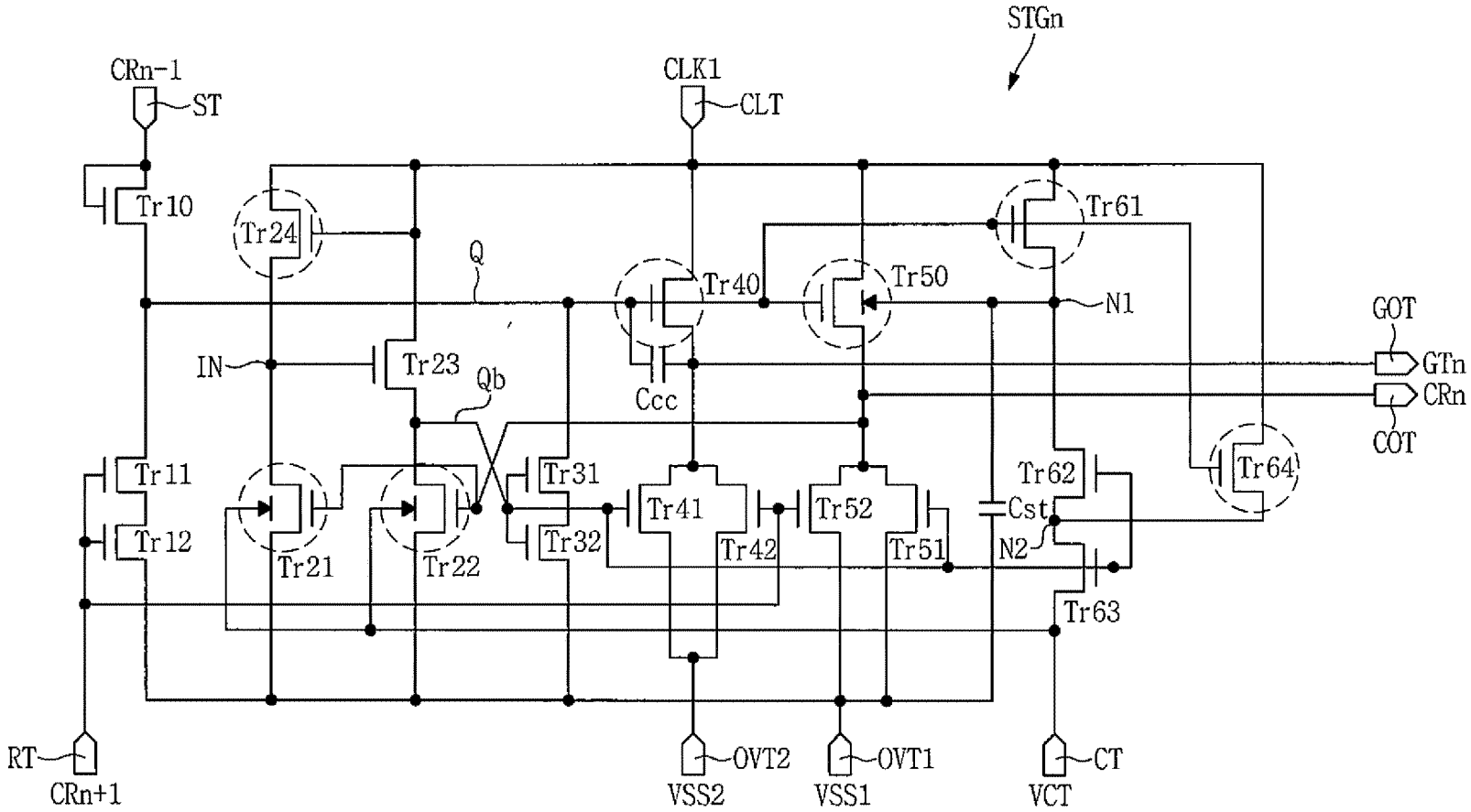

Subsequently, the operation of the $n^{th}$ stage STGn in an output period To of the $n^{th}$ stage STGn will be described with reference to FIGS. 3 and 6B.

In the output period To of the $n^{th}$ stage STGn, as illustrated in FIG. 3, the first clock signal CLK1 maintains a high voltage level corresponding to the on voltage Von, the second clock signal CLK2 maintains a low voltage level corresponding to the first off voltage VSS1, the $n-1^{th}$ gate signal GTn−1 applied from the $n-1^{th}$ stage STGn−1 maintains a low voltage level corresponding to the second off voltage VSS2, and the $n-1^{th}$ carry signal CRn−1 applied from the $n-1^{th}$ stage STGn−1 maintains a low voltage level corresponding to the first off voltage VSS1.

The $n-1^{th}$ carry signal CRn−1 having a low voltage level output from the $n-1^{th}$ stage STGn−1 is applied to the gate electrode of the set switching element Tr10 provided in the $n^{th}$ stage STGn. Accordingly, the set switching element Tr10 is turned off. As the set switching element Tr10 is turned off, the set node Q of the $n^{th}$ stage STGn is floated in the output period To. The set node Q in a floating state maintains a charged state by the $n-1^{th}$ carry signal CRn−1 having a high voltage level that is applied in the aforementioned set period Ts. Accordingly, the gate output switching element Tr40, the carry output switching element Tr50, the first control switching element Tr61, and the fourth control switching element Tr64 of the $n^{th}$ stage STGn connected to the charged set node Q through the respective gate electrodes maintain the turned-on state.

The first clock signal CLK1 having a high voltage level is applied to the gate output switching element Tr40, the carry output switching element Tr50, the first control switching element Tr61, and the fourth control switching element Tr64 that are in the turned-on state in the output period To. In such an embodiment, due to a coupling phenomenon occurring due to respective parasitic capacitors of the gate output switching element Tr40, the carry output switching element Tr50, the first control switching element Tr61, and the fourth control switching element Tr64, the signal of the set node Q is bootstrapped when the first clock signal CLK1 is applied to the gate output switching element Tr40, the carry output switching element Tr50, the first control switching element Tr61, and the fourth control switching element Tr64. In addition, when the set node Q is bootstrapped, due to a coupling phenomenon of the coupling capacitor Ccc, the signal of the gate output terminal GOT is also bootstrapped. Accordingly, the gate output switching element Tr40, the carry output switching element Tr50, the first control switching element Tr61, and the fourth control switching element Tr64 that are turned on output the first clock signal CLK1 having a high voltage level while experiencing a significantly small loss. In such an embodiment, the turned-on gate output switching element Tr40 outputs the first clock signal CLK1 having a high voltage level as the $n^{th}$ gate signal GTn through the gate output terminal GOT.

The first clock signal CLK1 having a high voltage level output through the turned-on first control switching element Tr61 is applied to the sub-gate electrode of the carry output switching element Tr50. Accordingly, a threshold voltage of the carry output switching element Tr50 decreases. That is, a voltage between the sub-gate electrode of the carry output switching element Tr50 and the carry output terminal COT (i.e., a sub-gate-source voltage of the carry output switching element Tr50) increases, which results in a decrease in threshold voltage of the carry output switching element Tr50. Herein, the aforementioned sub-gate-source voltage of the carry output switching element Tr50 is a forward voltage having a level greater than 0. Accordingly, driving capability of the carry output switching element Tr50 is improved, such that the $n^{th}$ gate signal GTn is normally output. The $n^{th}$ gate signal GTn output through the gate output terminal GOT of the $n^{th}$ stage STGn is applied to the $n^{th}$ gate line GLn.

The first clock signal CLK1 having a high voltage level applied to the sub-gate electrode of the carry output switching element Tr50 is stably maintained due to the storage capacitor Cst.

The turned-on carry output switching element Tr50 outputs the first clock signal CLK1 having a high voltage level as the $n^{th}$ carry signal CRn through the carry output terminal COT. The $n^{th}$ carry signal CRn output through the carry output terminal COT of the $n^{th}$ stage STGn is applied to the set control terminal ST of the $n+1^{th}$ stage STGn+1 and the reset control terminal RT of the $n-1^{th}$ stage STGn−1. In other words, the $n^{th}$ carry signal CRn is applied to a gate electrode and a drain electrode of a set switching element provided in the $n+1^{th}$ stage STGn+1. In addition, the $n^{th}$ carry signal CRn is applied to a gate electrode of a first reset switching element and a gate electrode of a second reset switching element provided in the $n-1^{th}$ stage STGn−1. Accordingly, the $n+1^{th}$ stage STGn+1 is set, and the $n-1^{th}$ stage STGn−1 is reset.

Through the turned-on fourth control switching element Tr64, the first clock signal CLK1 having a high voltage level is applied to the feedback node N2 between the second control switching element Tr62 and the third control switching element Tr63. Accordingly, a gate-source voltage of the second control switching element Tr62 decreases, such that the second control switching element Tr62 is substantially (e.g., completely) turned off. Accordingly, current leaking from the sub-gate electrode of the carry output switching element Tr50 to the control terminal CT is significantly reduced. In other words, the leakage current of the second control switching element Tr62 is significantly reduced. Accordingly, in the output period To, the first clock signal CLK1 having a high voltage level applied to the sub-gate electrode of the carry output switching element Tr50 may be stably maintained. Herein, the aforementioned gate-source voltage of the second control switching element Tr62 is a reverse voltage having a value less than 0 V.

The $n^{th}$ carry signal CRn is applied to the gate electrode of the first inverter switching element Tr21 and the gate electrode of the second inverter switching element Tr22 of the $n^{th}$ stage STGn. Accordingly, the first inverter switching element TR21 and the second inverter switching element Tr22 are turned on.

Through the turned-on first inverter switching element Tr21, the first off voltage VSS1 is applied to the inverter node IN, and thereby the inverter node IN is discharged. Accordingly, the third inverter switching element Tr23 connected to the discharged inverter node IN through the gate electrode thereof is turned off.

Through the turned-on second inverter switching element TR22, the first off voltage VSS1 is applied to the reset node Qb, and thereby the reset node Qb is discharged. Accordingly, the first set discharge switching element Tr31, the second set discharge switching element Tr32, the first gate discharge switching element Tr41, the first carry discharge switching element Tr51, the second control switching element Tr62, and the third control switching element Tr63 connected to the discharged reset node Qb through the respective gate electrodes maintain a turned-off state.

The first clock signal CLK1 having a high voltage level output in the output period To is applied to the gate electrode of the fourth inverter switching element Tr24. Accordingly, the fourth inverter switching element Tr24 is turned on, and the first clock signal CLK1 having a high voltage level is applied to the inverter node IN through the turned-on fourth inverter switching element Tr24. However, the first clock signal CLK1 having a high voltage level applied to the inverter node IN is discharged by the turned-on first inverter switching element Tr21. Accordingly, the inverter node IN maintains a discharged state in the output period To. Accordingly, as described in the foregoing, the third inverter switching element Tr23 connected to the discharged inverter node IN through the gate electrode thereof is turned off.

Accordingly, in the output period To of the $n^{th}$ stage STGn, the $n^{th}$ gate signal GTn and the $n^{th}$ carry signal CRn are output from the $n^{th}$ stage STGn. Further, based on the $n^{th}$ carry signal CRn, the $n+1^{th}$ stage STGn+1 is set, while the $n-1^{th}$ stage STGn−1 is reset.

3) Reset Period (Trs)

Figure 6C:
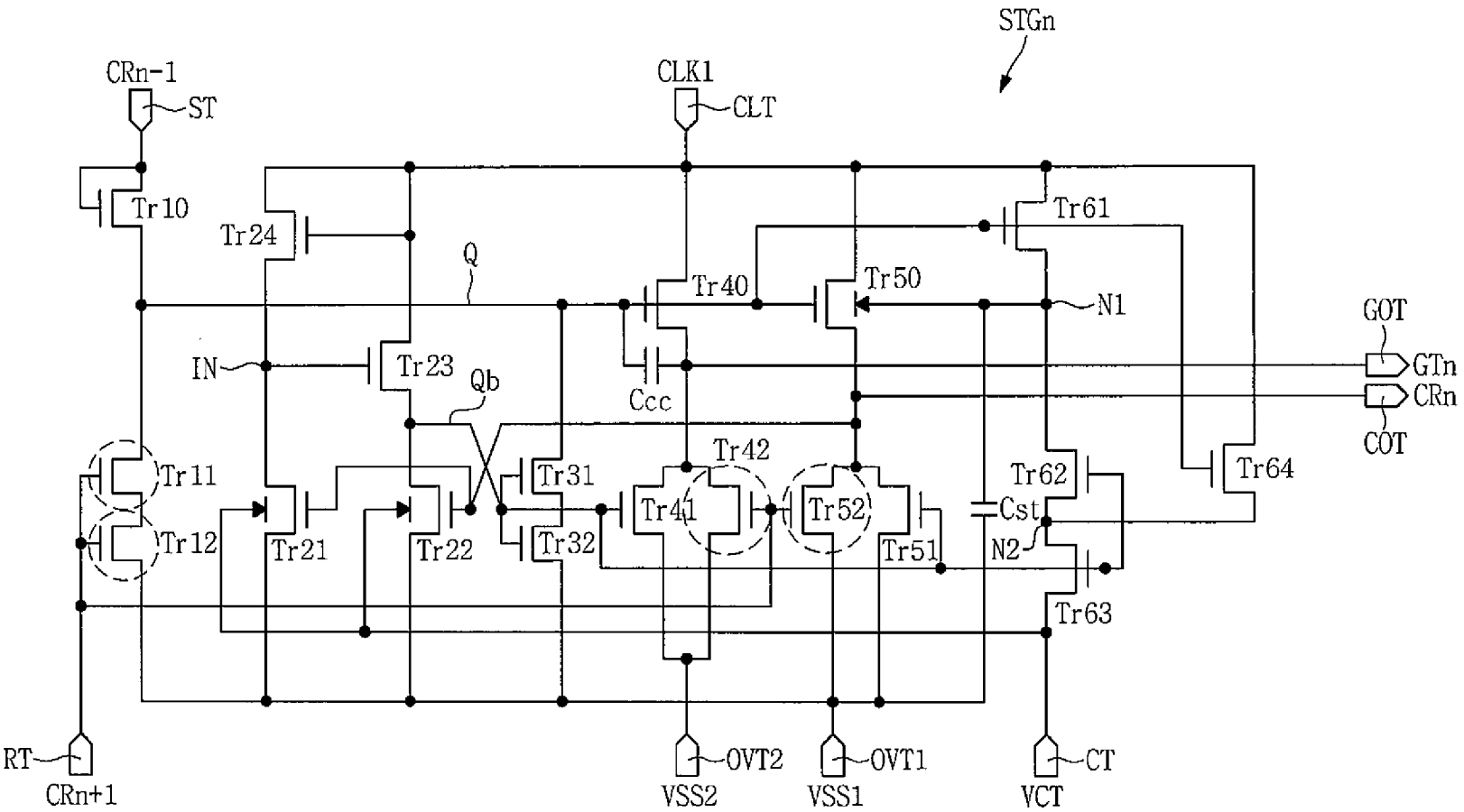

Subsequently, the operation of the $n^{th}$ stage STGn in the reset period Trs of the $n^{th}$ stage STGn will be described with reference to FIGS. 3 and 6C.

During the reset period Trs of the $n^{th}$ stage STGn, as illustrated in FIG. 3, the first clock signal CLK1 maintains a low voltage level corresponding to the first off voltage VSS1, the second clock signal CLK2 maintains a high voltage corresponding to the on voltage Von, and the $n+1^{th}$ gate signal and the $n+1^{th}$ carry signal CRn_1 from the $n+1^{th}$ stage STGn+1 each maintain a high voltage level corresponding to the on voltage Von.

The $n+1^{th}$ gate signal having a high voltage level is applied to the gate electrode of the first reset switching element Tr11, the gate electrode of the second reset switching element Tr12, the gate electrode of the second gate discharge switching element Tr42, and the gate electrode of the second carry discharge switching element Tr52 provided in the $n^{th}$ stage STGn. In such an embodiment, the first reset switching element Tr11, the second reset switching element Tr12, the second gate discharge switching element Tr42, and the second carry discharge switching element Tr52 are turned on.

The first off voltage VSS1 is applied to the set node Q of the $n^{th}$ stage STGn through the first reset switching element Tr11 and the second reset switching element Tr12 that are turned on. In such an embodiment, the set node Q is discharged, and the gate output switching element Tr40, the carry output switching element Tr50, the first control switching element Tr61, and the fourth control switching element Tr64 connected to the discharged set node Q through the respective gate electrodes are turned off.

Through the turned-on second gate discharge switching element Tr42, the second off voltage VSS2 is applied to the gate output terminal GOT of the $n^{th}$ stage STGn. Accordingly, the gate output terminal GOT and the $n^{th}$ gate line GLn connected thereto are discharged.

Through the turned-on second carry discharge switching element Tr52, the first off voltage VSS1 is applied to the carry output terminal COT of the $n^{th}$ stage STGn. Accordingly, the carry output terminal COT is discharged, and the set control terminal ST of the $n+1^{th}$ stage STGn+1 and the reset control terminal RT of the $n-1^{th}$ stage STGn−1 that are connected to the discharged carry output terminal COT are discharged. In such an embodiment, the set switching element provided in the $n+1^{th}$ stage STGn+1 is turned off. In addition, the first reset switching element, the second reset switching element, a second gate discharge switching element, and a second carry discharge switching element provided in the $n-1^{th}$ stage STGn−1 are turned off.

In addition, the first inverter switching element Tr21 and the second inverter switching element Tr22 of the $n^{th}$ stage STGn connected to the discharged carry output terminal COT through the respective gate electrodes are turned off.

The fourth inverter switching element Tr24 that receives the first clock signal CLK1 having a low voltage level through the gate electrode is turned off.

As the first inverter switching element Tr21 and the fourth inverter switching element Tr24 are turned off, the inverter node IN of the $n^{th}$ stage STGn is floated. The inverter node IN in the floating state maintains a discharged state by the first off voltage VSS1 applied in the aforementioned output period To. Accordingly, the third inverter switching element Tr23 connected to the discharged inverter node IN through the gate electrode thereof maintains the turned-off state.

As the second inverter switching element Tr22 and the third inverter switching element Tr23 are turned off, the reset node Qb is floated. The reset node Qb in the floating state maintains the discharged state by the first off voltage VSS1 applied in the aforementioned output period To. Accordingly, the first set discharge switching element Tr31, the second set discharge switching element Tr32, the first gate discharge switching element Tr41, the first carry discharge switching element Tr51, the second control switching element Tr62, and the third control switching element Tr63 connected to the discharged reset node Qb through the respective gate electrodes maintain the turned-off state.

Accordingly, as the set node Q is discharged to the low voltage in the reset period Trs of the $n^{th}$ stage STGn, the $n^{th}$ stage STGn is reset.

4) Holding Period (Th)

Figure 6D:
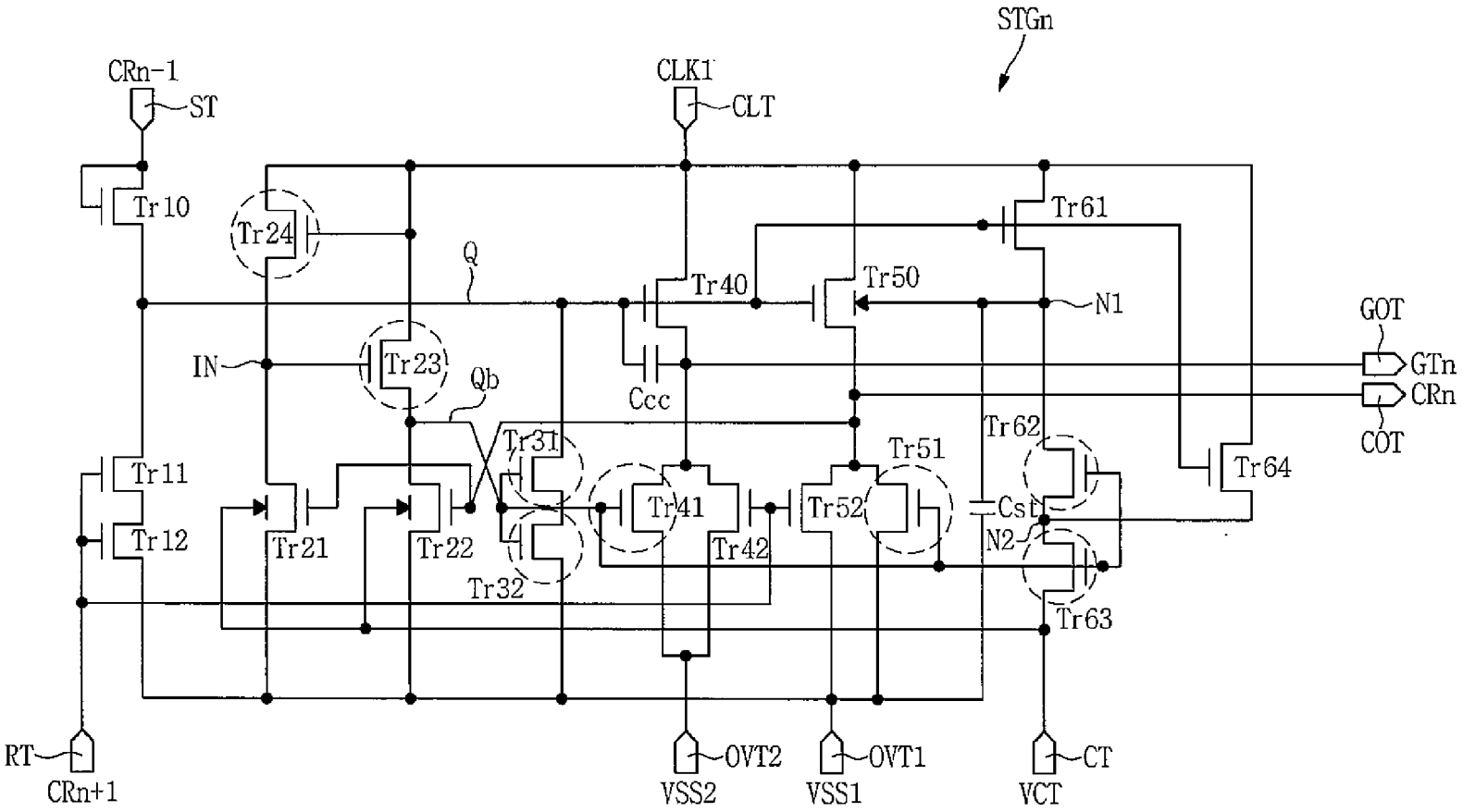

Next, the operation of the $n^{th}$ stage STGn in a holding period Th of the $n^{th}$ stage STGn will be described with reference to FIGS. 3 and 6D.

In the holding period Th of the $n^{th}$ stage STGn, as illustrated in FIG. 3, the first clock signal CLK1 maintains a high voltage level corresponding to the on voltage Von, the second clock signal CLK2 maintains a low voltage level corresponding to the first off voltage VSS1, the $n-1^{th}$ gate signal applied from the $n-1^{th}$ stage STGn−1 maintains a low voltage level corresponding to the second off voltage VSS2, the $n-1^{th}$ carry signal CRn−1 applied from the $n-1^{th}$ stage STGn−1 maintains a low voltage level corresponding to the first off voltage VSS1, the $n^{th}$ gate signal GTn applied from the $n^{th}$ stage STGn maintains a low voltage level corresponding to the second off voltage VSS2, the $n^{th}$ carry signal CRn applied from the $n^{th}$ stage STGn maintains a low voltage level corresponding to the first off voltage VSS1, the $n+1^{th}$ gate signal applied from the $n+1^{th}$ stage STGn+1 maintains a low voltage level corresponding to the second off voltage VSS2, and the $n+1^{th}$ carry signal CRn+1 applied from the $n+1^{th}$ stage STGn+1 maintains a low voltage level corresponding to the first off voltage VSS1.

The set switching element Tr10 that receives the $n-1^{th}$ carry signal CRn−1 having a low voltage level through the gate electrode thereof is turned off.

The first reset switching element Tr11, the second reset switching element Tr12, the second gate discharge switching element Tr42, and the second carry discharge switching element Tr52 that receive the $n+1^{th}$ carry signal CRn+1 having a low voltage level through the gate electrode are turned off.

The first inverter switching element Tr21 and the second inverter switching element Tr22 that receive the $n^{th}$ carry signal CRn having a low voltage level through the gate electrode are turned off. The control voltage VCT is applied to the sub-gate electrode of the first inverter switching element Tr21 and the sub-gate electrode of the second inverter switching element Tr22. Accordingly, a voltage between the sub-gate electrode of the first inverter switching element Tr21 and the first off-voltage input terminal OVT1 (i.e., a sub-gate-source voltage of the first inverter switching element Tr21) decreases such that a threshold voltage of the first inverter switching element Tr21 increases, and a voltage between the sub-gate electrode of the second inverter switching element Tr22 and the first off-voltage input terminal OVT1 (i.e., a sub-gate-source voltage of the second inverter switching element Tr22) decreases such that a threshold voltage of the second inverter switching element Tr22 increases. Accordingly, the first inverter switching element Tr21 and the second inverter switching element Tr22 maintain a substantially (e.g., completely) turned-off state. Accordingly, current leaking from the inverter node IN to the first off-voltage input terminal OVT1 and current leaking from the reset node Qb to the first off-voltage input terminal OVT1 in the holding period Th and subsequently thereto may be significantly reduced. In other words, the leakage current of the first inverter switching element Tr21 and the second inverter switching element Tr22 may be significantly reduced in the holding period Th and subsequently thereto. Herein, the aforementioned sub-gate-source voltage of the first inverter switching element Tr21 is a reverse voltage having a level less than 0 V, and the aforementioned sub-gate-source voltage of the second inverter switching element Tr22 is a reverse voltage having a level less than 0 V. The level of the reverse voltage may vary based on the level of the control voltage VCT. That is, as the leakage current applied from the shift register SR increases, in order to reduce the leakage current, the sub-gate-source voltage of the second inverter switching element Tr22 needs to decrease to a level less than 0 V, and accordingly, a control voltage VCT having a lower level is selected as the leakage current increases.

Because the first inverter switching element Tr21 and the second inverter switching element Tr22 receive the $n^{th}$ carry signal CRn having a low voltage level for substantially the entire period of a single frame period FR, the threshold voltages thereof are shifted to be gradually decreased, but the decreasing tendency of the threshold voltages may be weakened by the control voltage VCT. That is, as the control voltage VCT serves to increase the threshold voltage, a level of the shift in the threshold voltage is significantly reduced.

In addition, due to a process error or the like in a process of manufacturing the shift register SR, the threshold voltages of the first inverter switching element Tr21 and the second inverter switching element Tr22 may be abnormally low, and in such a case, the threshold voltages of the first inverter switching element Tr21 and the second inverter switching element Tr22 may be restored to a normal level by the control voltage VCT.

The fourth inverter switching element Tr24 that receives the first clock signal CLK1 having a high voltage level through the gate electrode thereof is turned on.

Through the turned-on fourth inverter switching element Tr24, the first clock signal CLK1 having a high voltage level is applied to the inverter node IN. Accordingly, the inverter node IN is charged, and the third inverter switching element Tr23 connected to the charged inverter node IN through the gate electrode thereof is turned on.

Through the turned-on third inverter switching element Tr23, the first clock signal CLK1 having a high voltage level is applied to the reset node Qb. Accordingly, the reset node Qb is charged, and the first set discharge switching element Tr31, the second set discharge switching element Tr32, the first gate discharge switching element Tr41, the first carry discharge switching element Tr51, the second control switching element Tr62, and the third control switching element Tr63 connected to the charged reset node Qb through the respective gate electrodes are turned on.

The first off voltage VSS1 is applied to the set node Q of the $n^{th}$ stage STGn through the first set discharge switching element Tr31 and the second set discharge switching element Tr32 that are turned on. Accordingly, the set node Q is discharged, and the gate output switching element Tr40, the carry output switching element Tr50, the first control switching element Tr61, and the fourth control switching element Tr64 connected to the discharged set node Q through the respective gate electrodes are turned off.

Through the turned-on first gate discharge switching element Tr41, the second off voltage VSS2 is applied to the gate output terminal GOT of the $n^{th}$ stage STGn. Accordingly, the gate output terminal GOT and the $n^{th}$ gate line connected thereto are discharged.

Through the turned-on first carry discharge switching element Tr51, the first off voltage VSS1 is applied to the carry output terminal COT of the $n^{th}$ stage STGn. Accordingly, the carry output terminal COT of the $n^{th}$ stage STGn, the set control terminal ST of the $n+1^{th}$ stage STGn+1, and the reset control terminal RT of the $n-1^{th}$ stage STGn−1 are discharged.

The control voltage VCT is applied to the sub-gate electrode of the carry output switching element Tr50 through the turned-on second and third control switching elements Tr62 and Tr63. Accordingly, a voltage between the sub-gate electrode of the carry output switching element Tr50 and the carry output terminal COT (i.e., the sub-gate-source voltage of the carry output switching element Tr50) decreases, which results in an increase in threshold voltage of the carry output switching element Tr50. Accordingly, the carry output switching element Tr50 maintains a substantially (e.g., completely) turned-off state, and current leaking from the first clock line CL1 to the carry output terminal COT may be significantly reduced in the holding period Th and subsequently thereto. In other words, the leakage current of the carry output switching element Tr50 is significantly reduced in the holding period Th and subsequently thereto. Herein, the aforementioned sub-gate-source voltage of the carry output switching element Tr50 is a reverse voltage having a level less than 0 V.

The control voltage VCT applied to the sub-gate electrode of the carry output switching element Tr50 is stably maintained by the storage capacitor Cst.

As the first clock signal CLK1 periodically maintains a high voltage level, each time the first clock signal CLK1 maintains the high voltage level, the third inverter switching element Tr23 of the $n^{th}$ stage STGn that is reset is turned on such that the reset node Qb is charged by the first clock signal CLK1. Each time the reset node Qb is charged, the first set discharge switching element Tr31, the second set discharge switching element Tr32, the first gate discharge switching element Tr41, the first carry discharge switching element Tr51, the second control switching element Tr62, and the third control switching element Tr63 are turned on, and thus the set node Q, the gate output terminal GOT, and the carry output terminal COT are stabilized with the first off voltage VSS1 or the second off voltage VSS2. Accordingly, the reset node Qb, the gate output terminal GOT, and the carry output terminal COT of the $n^{th}$ stage STGn that is reset are periodically discharged based on the first clock signal CLK1 until the $n^{th}$ stage STGn is set once more.

Figure 7:
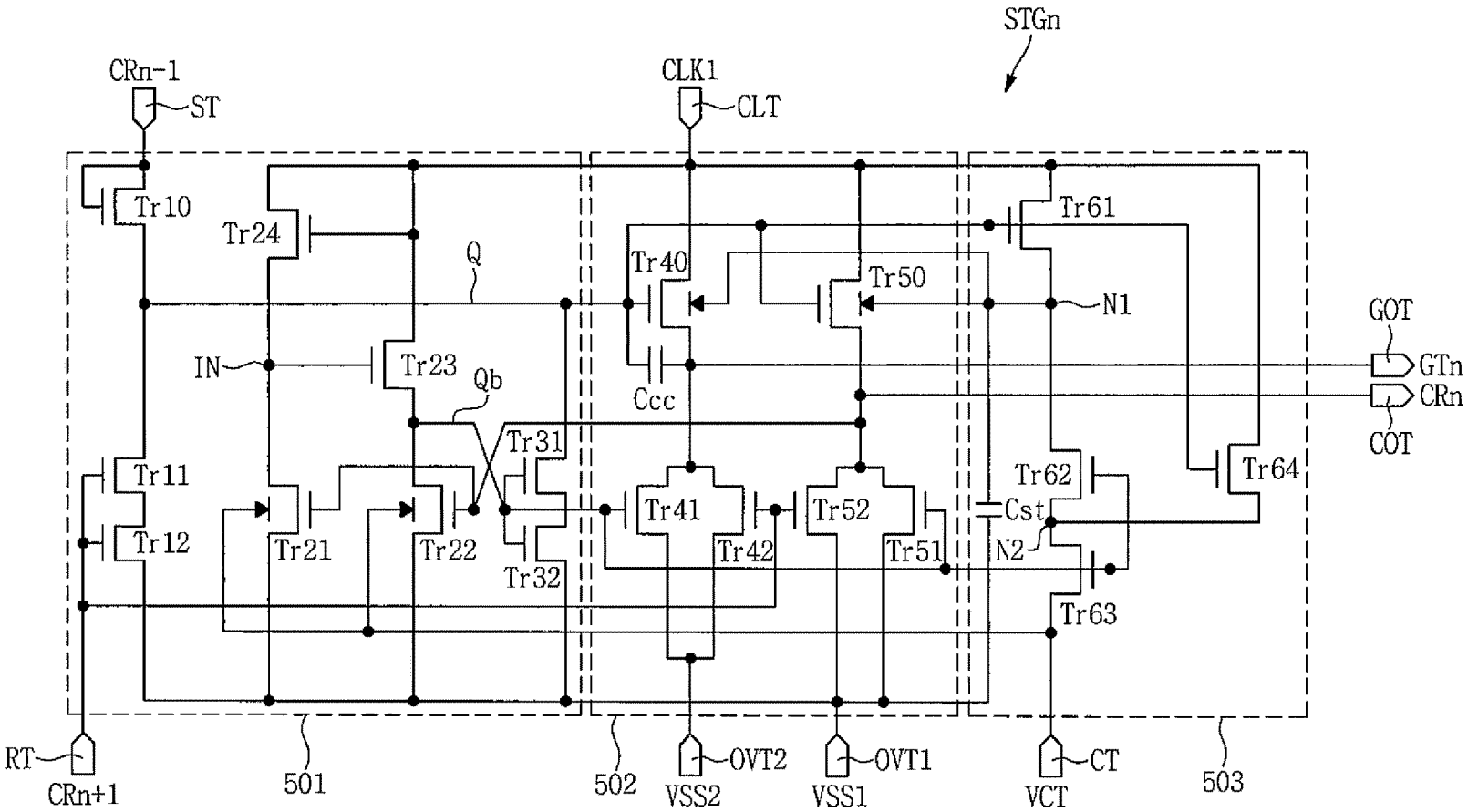
FIG. 7 is another configuration view illustrating the $n^{th}$ stage of FIG. 2.

FIG. 7 is another configuration view illustrating the $n^{th}$ stage STGn of FIG. 2.

Because a set switching element Tr10, a first inverter switching element Tr21, a second inverter switching element Tr22, a third inverter switching element Tr23, a fourth inverter switching element Tr24, a carry output switching element Tr50, a first gate discharge switching element Tr41, a second gate discharge switching element Tr42, a first carry discharge switching element Tr51, a second carry discharge switching element Tr52, a first control switching element Tr61, a second control switching element Tr62, a third control switching element Tr63, a fourth control switching element Tr64, a coupling capacitor Ccc, and a storage capacitor Cst provided in the $n^{th}$ stage STGn illustrated in FIG. 7 are respectively the same as the set switching element Tr10, the first inverter switching element Tr21, the second inverter switching element Tr22, the third inverter switching element Tr23, the fourth inverter switching element Tr24, the carry output switching element Tr50, the first gate discharge switching element Tr41, the second gate discharge switching element Tr42, the first carry discharge switching element Tr51, the second carry discharge switching element Tr52, the first control switching element Tr61, the second control switching element Tr62, the third control switching element Tr63, the fourth control switching element Tr64, the coupling capacitor Ccc, and the storage capacitor Cst illustrated in FIG. 5, descriptions with respect to the aforementioned configurations and elements illustrated in FIG. 7 will make reference to FIG. 5 and the corresponding descriptions.

The gate output switching element Tr40 of the $n^{th}$ stage STGn illustrated in FIG. 7 outputs a first clock signal CLK1 as an $n^{th}$ gate signal GTn based on a signal of a set node Q and an output of an output control unit 503 of the $n^{th}$ stage STGn. A gate output switching element Tr40 of the $n^{th}$ stage STGn is turned on or turned off by the signal of the set node Q and the output of the output control unit 503, and when turned on, the gate output switching element Tr40 electrically connects a clock input terminal CLT of the $n^{th}$ stage STGn and a gate output terminal GOT of the $n^{th}$ stage STGn. To this end, the gate output switching element Tr40 includes a gate electrode connected to the set node Q and a sub-gate electrode connected to an output terminal N1 of the output control unit 503, and is connected between the clock input terminal CLT and the gate output terminal GOT.

Figure 8:
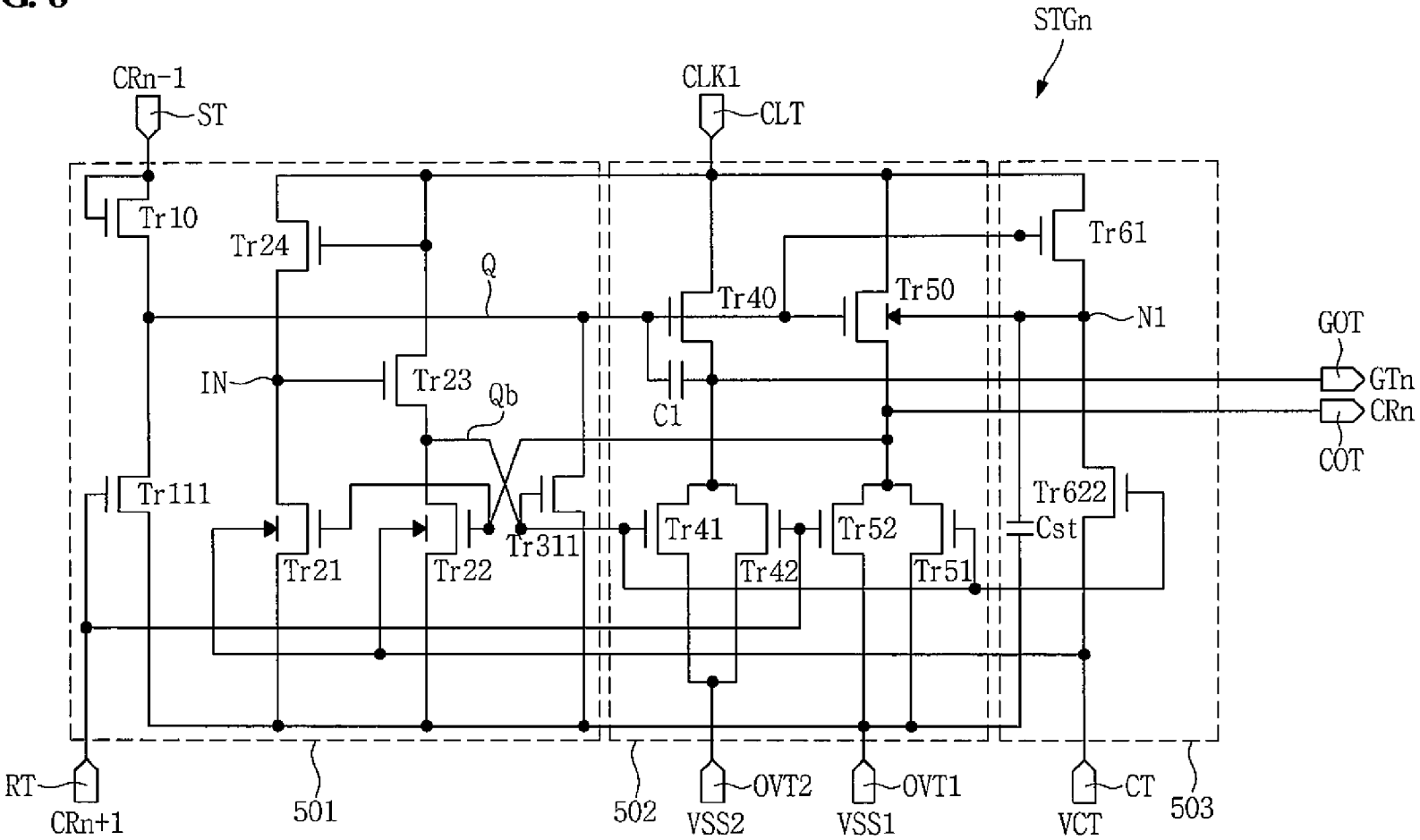
FIG. 8 is still another configuration view illustrating the $n^{th}$ stage of FIG. 2.

FIG. 8 is still another configuration view illustrating the $n^{th}$ stage STGn of FIG. 2;

Because a set switching element Tr10, a first inverter switching element Tr21, a second inverter switching element Tr22, a third inverter switching element Tr23, a fourth inverter switching element Tr24, a gate output switching element Tr40, a carry output switching element Tr50, a first gate discharge switching element Tr41, a second gate discharge switching element Tr42, a first carry discharge switching element Tr51, a second carry discharge switching element Tr52, a first control switching element Tr61, a coupling capacitor Ccc, and a storage capacitor Cst provided in the $n^{th}$ stage STGn illustrated in FIG. 8 are respectively the same as the set switching element Tr10, the first inverter switching element Tr21, the second inverter switching element Tr22, the third inverter switching element Tr23, the fourth inverter switching element Tr24, the gate output switching element Tr40, the carry output switching element Tr50, the first gate discharge switching element Tr41, the second gate discharge switching element Tr42, the first carry discharge switching element Tr51, the second carry discharge switching element Tr52, the first control switching element Tr61, the coupling capacitor Ccc, and the storage capacitor Cst illustrated in FIG. 5, descriptions with respect to the aforementioned configurations and elements illustrated in FIG. 8 will make reference to FIG. 5 and the corresponding descriptions.

A reset switching element Tr111 of the $n^{th}$ stage STGn illustrated in FIG. 8 discharges a set node Q of the $n^{th}$ stage STGn based on a reset control signal. The reset control signal may be an $n+1^{th}$ carry signal CRn+1 applied from an $n+1^{th}$ stage STGn+1. The reset switching element Tr111 of the $n^{th}$ stage STGn is turned on or turned off by the $n+1^{th}$ carry signal CRn+1, and when turned on, the reset switching element Tr111 electrically connects the set node Q and a first off-voltage input terminal OVT1 of the $n^{th}$ stage STGn. To this end, the reset switching element Tr111 includes a gate electrode connected to a reset control terminal RT, and is connected between the set node Q and the first off-voltage input terminal OVT1. The reset switching element Tr111 may further include a sub-gate electrode to which a control voltage VCT output from a control-voltage generating unit 800 is applied.

A set discharge switching element Tr311 of the $n^{th}$ stage STGn illustrated in FIG. 8 discharges the set node Q of the $n^{th}$ stage STGn based on a signal applied to a reset node Qb of the $n^{th}$ stage STGn. The set discharge switching element Tr311 of the $n^{th}$ stage STGn is turned on or turned off by the signal applied to the reset node Qb, and when turned on, the set discharge switching element Tr311 electrically connects the set node Q and the first off-voltage input terminal OVT1 of the $n^{th}$ stage STGn. To this end, the set discharge switching element Tr311 includes a gate electrode connected to the reset node Qb, and is connected between the set node Q and the first off-voltage input terminal OVT1. The set discharge switching element Tr311 may further include a sub-gate electrode to which the control voltage VCT output from the control-voltage generating unit 800 is applied.

A second control switching element Tr622 of the $n^{th}$ stage STGn illustrated in FIG. 8 applies the control voltage VCT to a sub-gate electrode of the carry output switching element Tr50 provided in the $n^{th}$ stage STGn based on the signal of the reset node Qb provided in the $n^{th}$ stage STGn. The second control switching element Tr622 of the $n^{th}$ stage STGn is turned on or turned off by the signal of the reset node Qb, and when turned on, the second control switching element Tr622 electrically connects the sub-gate electrode of the carry output switching element Tr50 and a control terminal CT of the $n^{th}$ stage STGn. To this end, the second control switching element Tr622 includes a gate electrode connected to the reset node Qb, and is connected between the sub-gate electrode of the carry output switching element Tr50 and the control terminal CT.

Figure 9:
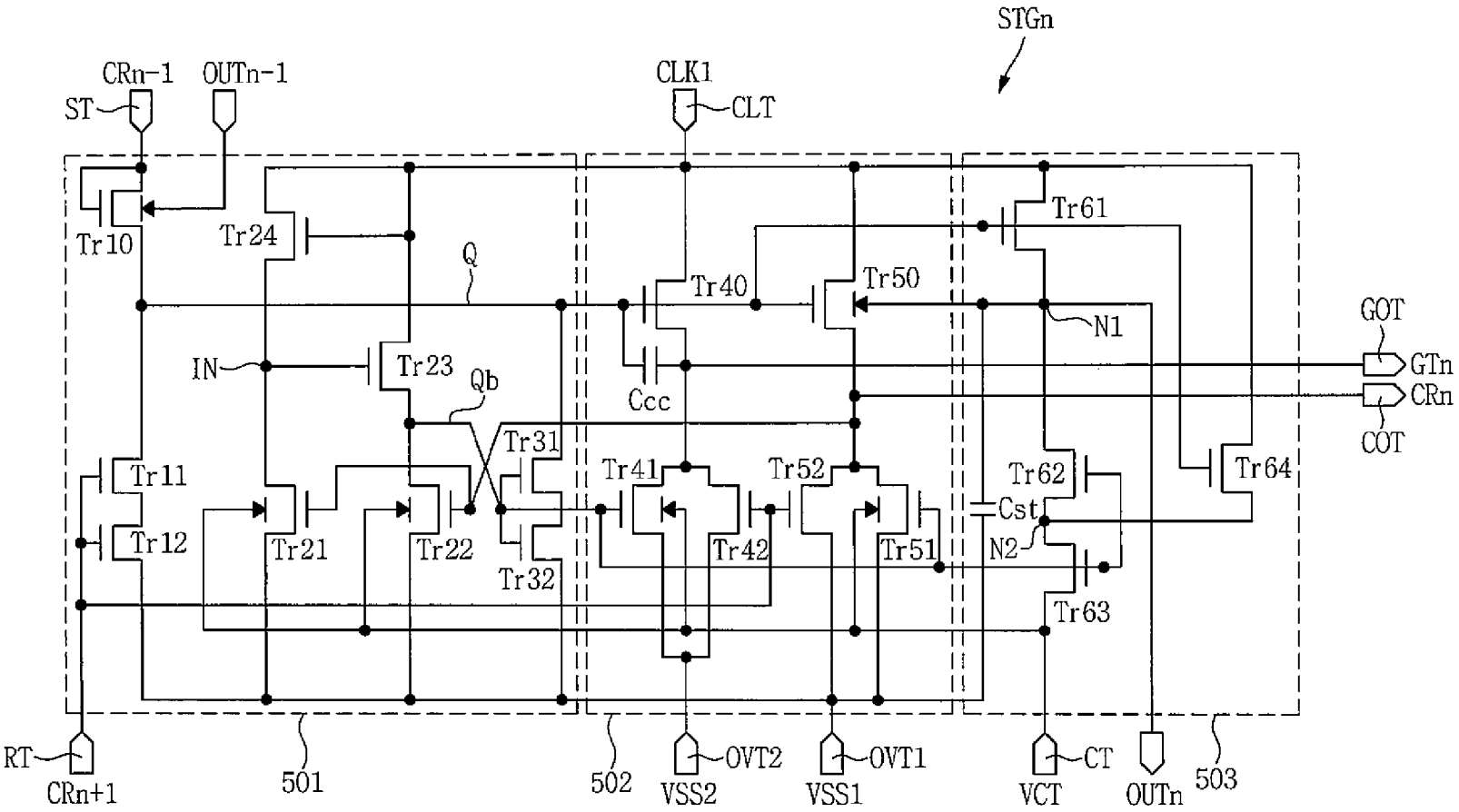
FIG. 9 is yet another configuration view illustrating the $n^{th}$ stage of FIG. 2.

FIG. 9 is yet another configuration view illustrating the $n^{th}$ stage STGn of FIG. 2.

Because a first reset switching element Tr11, a second reset switching element Tr12, a first inverter switching element Tr21, a second inverter switching element Tr22, a third inverter switching element Tr23, a fourth inverter switching element Tr24, a gate output switching element Tr40, a carry output switching element Tr50, a second gate discharge switching element Tr42, a second carry discharge switching element Tr52, a first control switching element Tr61, a second control switching element Tr62, a third control switching element Tr63, a fourth control switching element Tr64, a coupling capacitor Ccc, and a storage capacitor Cst provided in the $n^{th}$ stage STGn illustrated in FIG. 9 are respectively the same as the first reset switching element Tr11, the second reset switching element Tr12, the first inverter switching element Tr21, the second inverter switching element Tr22, the third inverter switching element Tr23, the fourth inverter switching element Tr24, the gate output switching element Tr40, the carry output switching element Tr50, the second gate discharge switching element Tr42, the second carry discharge switching element Tr52, the first control switching element Tr61, the second control switching element Tr62, the third control switching element Tr63, the fourth control switching element Tr64, the coupling capacitor Ccc, and the storage capacitor Cst illustrated in FIG. 5, descriptions with respect to the aforementioned configurations and elements illustrated in FIG. 9 will make reference to FIG. 5 and the corresponding descriptions.

A set switching element Tr10 of the $n^{th}$ stage STGn illustrated in FIG. 9 charges a set node Q of the $n^{th}$ stage STGn based on a set control signal and an output of an output control unit 503 provided in a previous stage. The set control signal may be an $n-1^{th}$ carry signal CRn−1 applied from the $n-1^{th}$ stage STGn−1. In addition, the output control unit 503 of the previous stage may be an output control unit 503 of the $n-1^{th}$ stage STGn−1. An output OUTn−1 of the output control unit 503 provided in the $n-1^{th}$ stage STGn−1 is one of a second clock signal CLK2 having a high voltage level and a control voltage VCT. The set switching element Tr10 of the $n^{th}$ stage STGn is turned on or turned off by the $n-1^{th}$ carry signal CRn−1 applied from the $n-1^{th}$ stage STGn−1 and the output OUTn−1 of the output control unit 503 provided in the n−1$^{th}$ stage STGn−1, and when turned on, the set switching element Tr10 electrically connects a set control terminal ST of the n$^{th}$ stage STGn and the set node Q of the n$^{th}$ stage STGn. To this end, the set switching element Tr10 includes a gate electrode connected to the set control terminal ST and a sub-gate electrode to which the output OUTn−1 is applied from the output control unit 503 of the n−1$^{th}$ stage STGn−1, and is connected between the set control terminal ST and the set node Q.

An output OUTn applied from the output control unit 503 of the n$^{th}$ stage STGn illustrated in FIG. 9 is applied to a sub-gate electrode of the carry output switching element Tr50 provided in the n$^{th}$ stage STGn and a sub-gate electrode of a set switching element Tr10 provided in the n+1$^{th}$ stage STGn+1. To this end, an output terminal N1 of the output control unit 503 illustrated in FIG. 9 is connected to the sub-gate electrode of the carry output switching element Tr50 provided in the n$^{th}$ stage STGn and the sub-gate electrode of the set switching element Tr10 provided in the n+1$^{th}$ stage STGn+1.

A first gate discharge switching element Tr41 of the n$^{th}$ stage illustrated in FIG. 9 discharges a gate output terminal GOT of the n$^{th}$ stage STGn based on a signal applied to a reset node Qb of the n$^{th}$ stage STGn and a control voltage VCT applied to a control terminal CT of the n$^{th}$ stage STGn. The first gate discharge switching element Tr41 of the n$^{th}$ stage STGn is turned on or turned off by the signal of the reset node Qb and the control voltage VCT, and when turned on, the first gate discharge switching element Tr41 electrically connects the gate output terminal GOT and the second off-voltage input terminal OVT2 of the n$^{th}$ stage STGn. To this end, the first gate discharge switching element Tr41 includes a gate electrode connected to the reset node Qb and a sub-gate electrode connected to the control terminal CT, and is connected between the gate output terminal GOT and the second off-voltage input terminal OVT2.

A first carry discharge switching element Tr51 of the n$^{th}$ stage STGn illustrated in FIG. 9 discharges a carry output terminal COT of the n$^{th}$ stage STGn based on the signal applied to the reset node Qb of the n$^{th}$ stage STGn and the control voltage VCT applied to the control terminal CT of the n$^{th}$ stage STGn. The first carry discharge switching element Tr51 of the nth stage STGn is turned on or turned off by the signal of the reset node Qb and the control voltage VCT, and when turned on, the first carry discharge switching element Tr51 electrically connects the carry output terminal COT and the first off-voltage input terminal OVT1 of the n$^{th}$ stage STGn. To this end, the first carry discharge switching element Tr51 includes a gate electrode connected to the reset node Qb and a sub-gate electrode connected to the control terminal CT, and is connected between the carry output terminal COT and the first off-voltage input terminal OVT1.

Due to a process error or the like in a process of manufacturing a shift register SR, threshold voltages of the first gate discharge switching element Tr41 and the first carry discharge switching element Tr51 may be abnormally low. In such a case, the threshold voltages of the first gate discharge switching element Tr41 and the first carry discharge switching element Tr51 may be restored to a normal level by the control voltage VCT.

Figure 10:
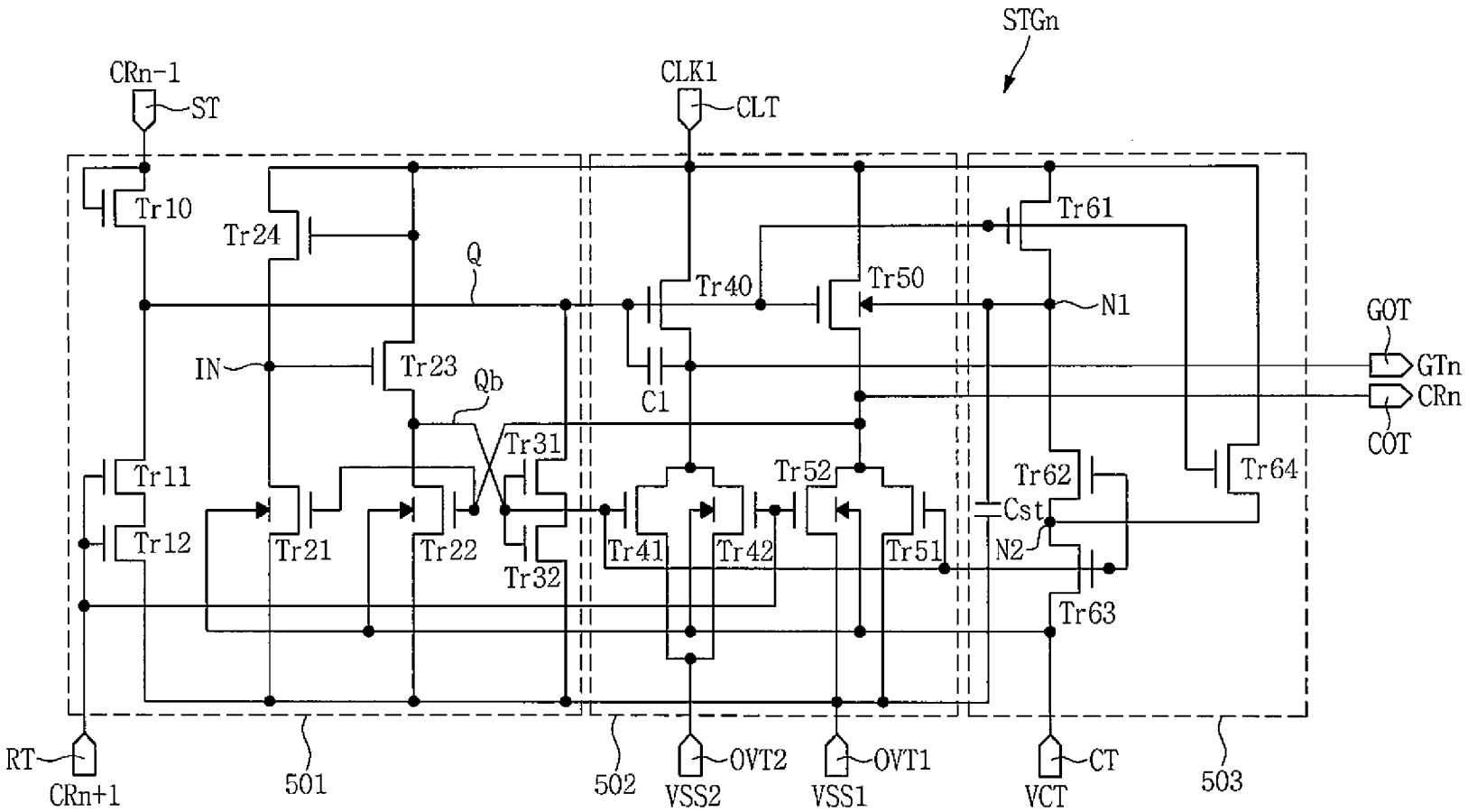
FIG. 10 is yet another configuration view illustrating the $n^{th}$ stage of FIG. 2.

FIG. 10 is yet another configuration view illustrating the n$^{th}$ stage STGn of FIG. 2.

Because a set switching element Tr10, a first reset switching element Tr11, a second reset switching element Tr12, a first inverter switching element Tr21, a second inverter switching element Tr22, a third inverter switching element Tr23, a fourth inverter switching element Tr24, a gate output switching element Tr40, a carry output switching element Tr50, a first gate discharge switching element Tr41, a first carry discharge switching element Tr51, a first control switching element Tr61, a second control switching element Tr62, a third control switching element Tr63, a fourth control switching element Tr64, a coupling capacitor Ccc, and a storage capacitor Cst provided in the n$^{th}$ stage STGn illustrated in FIG. 10 are respectively the same as the set switching element Tr10, the first reset switching element Tr11, the second reset switching element Tr12, the first inverter switching element Tr21, the second inverter switching element Tr22, the third inverter switching element Tr23, the fourth inverter switching element Tr24, the gate output switching element Tr40, the carry output switching element Tr50, the first gate discharge switching element Tr41, the first carry discharge switching element Tr51, the first control switching element Tr61, the second control switching element Tr62, the third control switching element Tr63, the fourth control switching element Tr64, the coupling capacitor Ccc, and the storage capacitor Cst illustrated in FIG. 5, descriptions with respect to the aforementioned configurations and elements illustrated in FIG. 10 will make reference to FIG. 5 and the corresponding descriptions.

A second gate discharge switching element Tr42 of the n$^{th}$ stage STGn illustrated in FIG. 10 discharges a gate output terminal GOT of the n$^{th}$ stage STGn based on a reset control signal and a control voltage VCT applied to a control terminal CT of the n$^{th}$ stage STGn. The reset control signal may be an n+1$^{th}$ carry signal CRn+1 applied from the n+1$^{th}$ stage STGn+1. The second gate discharge switching element Tr42 of the n$^{th}$ stage STGn is turned on or turned off by the n+1$^{th}$ carry signal CRn+1 and the control voltage VCT of the control terminal CT, and when turned on, the second gate discharge switching element Tr42 electrically connects the gate output terminal GOT and a second off-voltage input terminal OVT2 of the n$^{th}$ stage STGn. To this end, the second gate discharge switching element Tr42 includes a gate electrode connected to a reset control terminal RT and a sub-gate electrode connected to the control terminal CT of the n$^{th}$ stage STGn, and is connected between the gate output terminal GOT and the second off-voltage input terminal OVT2.

A second carry discharge switching element Tr52 of the n$^{th}$ stage STGn illustrated in FIG. 10 discharges a carry output terminal COT of the n$^{th}$ stage STGn based on the reset control signal and the control voltage VCT applied to the control terminal CT of the n$^{th}$ stage STGn. The reset control signal may be the n+1$^{th}$ carry signal CRn+1 applied from the n+1$^{th}$ stage STGn+1. The second carry discharge switching element Tr52 of the n$^{th}$ stage STGn is turned on or turned off by the n+1$^{th}$ carry signal CRn+1 and the control voltage VCT of the control terminal CT, and when turned on, the second carry discharge switching element Tr52 electrically connects the carry output terminal COT and a first off-voltage input terminal OVT1 of the n$^{th}$ stage STGn. To this end, the second carry discharge switching element Tr52 includes a gate electrode connected to the reset control terminal RT and a sub-gate electrode connected to the control terminal CT of the n$^{th}$ stage STGn, and is connected between the carry output terminal COT and the first off-voltage input terminal OVT1.

Because the second gate discharge switching element Tr42 and the second carry discharge switching element Tr52 receive the n−1$^{th}$ carry signal CRn−1 having a low voltage level for substantially the entire period of a single frame period FR, threshold voltages thereof are shifted to be gradually decreased, but the decreasing tendency of the threshold voltages may be weakened by the control voltage VCT.

Due to a process error or the like in a process of manufacturing a shift register SR, threshold voltages of the second gate discharge switching element Tr42 and the second carry discharge switching element Tr52 may be abnormally low, and in such a case, the threshold voltages of the second gate discharge switching element Tr42 and the second carry discharge switching element Tr52 may be restored to a normal level by the control voltage VCT.

Figure 11:
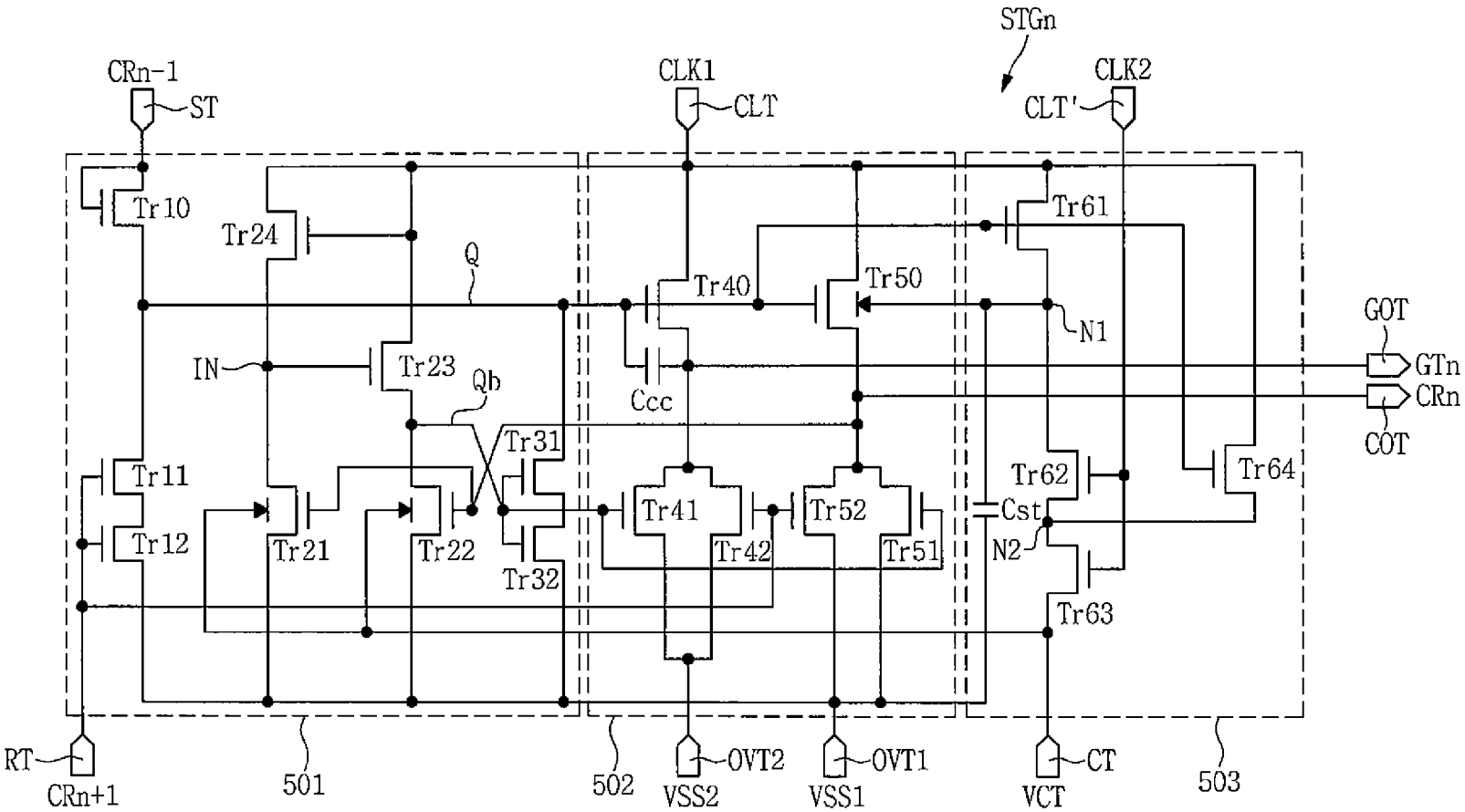
FIG. 11 is yet another configuration view illustrating the $n^{th}$ stage of FIG. 2.

FIG. 11 is yet another configuration view illustrating the $n^{th}$ stage STGn of FIG. 2.

Because a set switching element Tr10, a first reset switching element Tr11, a second reset switching element Tr12, a first inverter switching element Tr21, a second inverter switching element Tr22, a third inverter switching element Tr23, a fourth inverter switching element Tr24, a gate output switching element Tr40, a carry output switching element Tr50, a first gate discharge switching element Tr41, a first carry discharge switching element Tr51, a first control switching element Tr61, a fourth control switching element Tr64, a coupling capacitor Ccc, and a storage capacitor Cst provided in the $n^{th}$ stage STGn illustrated in FIG. 11 are respectively the same as the set switching element Tr10, the first reset switching element Tr11, the second reset switching element Tr12, the first inverter switching element Tr21, the second inverter switching element Tr22, the third inverter switching element Tr23, the fourth inverter switching element Tr24, the gate output switching element Tr40, the carry output switching element Tr50, the first gate discharge switching element Tr41, the first carry discharge switching element Tr51, the first control switching element Tr61, the fourth control switching element Tr64, the coupling capacitor Ccc, and the storage capacitor Cst illustrated in FIG. 5, descriptions with respect to the aforementioned configurations and elements illustrated in FIG. 11 will make reference to FIG. 5 and the corresponding descriptions.

A second control switching element Tr62 of the $n^{th}$ stage STGn illustrated in FIG. 11 applies a control voltage VCT to a sub-gate electrode of the carry output switching element Tr50 provided in the $n^{th}$ stage STGn based on a second clock signal CLK2 applied to an other clock input terminal CLT' of the $n^{th}$ stage STGn. The second control switching element Tr62 of the $n^{th}$ stage STGn is turned on or turned off by the second clock signal CLK2, and when turned on, the second control switching element Tr62 electrically connects the sub-gate electrode of the carry output switching element Tr50 and a third control switching element Tr63 of the $n^{th}$ stage STGn. To this end, the second control switching element Tr62 includes a gate electrode connected to the other clock input terminal CLT' and is connected between the sub-gate electrode of the carry output switching element Tr50 and the third control switching element Tr63.

The third control switching element Tr63 of the $n^{th}$ stage STGn illustrated in FIG. 11 applies the control voltage VCT to the sub-gate electrode of the carry output switching element Tr50 provided in the $n^{th}$ stage STGn based on the second clock signal CLK2 applied to the other clock input terminal CLT' of the $n^{th}$ stage STGn. The third control switching element Tr63 of the $n^{th}$ stage STGn is turned on or turned off by the second clock signal CLK2, and when turned on, the third control switching element Tr63 of the $n^{th}$ stage STGn electrically connects the second control switching element Tr62 of the $n^{th}$ stage STGn and a control terminal CT of the $n^{th}$ stage STGn. To this end, the third control switching element Tr63 includes a gate electrode connected to the other clock input terminal CLT', and is connected between the second control switching element Tr62 and the control terminal CT.

In a case where the stages STG1 to STGi each include the circuit configuration illustrated in FIG. 11, each of the stages STG1 to STGi includes two clock input terminals CLT and CLT to which different clock signals are applied, respectively.

The odd-numbered stages including the $n^{th}$ stage STGn may include one of the circuit configurations illustrated in FIGS. 5, 7, 8, 9, 10, and 11.

The even-numbered stages may each include one of the aforementioned circuit configurations illustrated in FIGS. 5, 7, 8, 9, and 10. However, a fourth inverter switching element Tr24, a gate output switching element Tr40, a carry output switching element Tr50, a first control switching element Tr61, and a fourth control switching element Tr64 of the even-numbered stage receive the second clock signal CLK2 rather than the first clock signal CLK1.

In addition, the even-numbered stages may also have the circuit configuration illustrated in FIG. 11. However, in a case where the even-numbered stage has the circuit configuration illustrated in FIG. 11, a fourth inverter switching element Tr24, a gate output switching element Tr40, a carry output switching element Tr50, a first control switching element Tr61, and a fourth control switching element Tr64 of the even-numbered stage receive the second clock signal CLK2 rather than the first clock signal CLK1, and a second control switching element Tr62 and a third control switching element Tr63 of the even-numbered stage each receive the first clock signal CLK1 rather than the second clock signal CLK2.

At least one switching element that receives a DC voltage through one of a source electrode thereof and a drain electrode thereof among the aforementioned switching elements Tr10, Tr11, Tr21, Tr22, Tr23, Tr24, Tr31, Tr32, Tr40, Tr41, Tr42, Tr50, Tr51, Tr52, Tr61, Tr62, Tr63, Tr64, Tr111, Tr311, and Tr622 may include a sub-gate electrode to which the control voltage VCT is applied from the control-voltage generating unit 800. For example, the second reset switching element Tr12, the reset switching element Tr111, the first inverter switching element Tr21, the second inverter switching element Tr22, the second set discharge switching element Tr32, the set discharge switching element Tr311, the first gate discharge switching element Tr41, the second gate discharge switching element Tr42, the first carry discharge switching element Tr51, and the second carry discharge switching element Tr52 described in the foregoing each receive the first off voltage VSS1 or the second off voltage VSS2 that are both DC voltages, and at least one of the above-listed switching elements may include the sub-gate electrode to which the control voltage VCT is applied from the control-voltage generating unit 800.

At least one switching element that is involved in input and output of the stage among the aforementioned switching elements Tr10, Tr11, Tr21, Tr22, Tr23, Tr24, Tr31, Tr32, Tr40, Tr41, Tr42, Tr50, Tr51, Tr52, Tr61, Tr62, Tr63, Tr64, Tr111, Tr311, and Tr622 may include a sub-gate electrode to which the output (e.g., the first clock signal CLK1, the second clock signal CLK2, or the control voltage VCT) is applied from the output control unit 503. For example, at least one of the carry output switching element Tr50 outputting the carry signal of the stage, the gate output switching element Tr40 outputting the gate signal of the stage, and the set switching element Tr10 receiving the set control signal of the stage may include a sub-gate electrode to which the output is applied from the output control unit 503.

The switching elements Tr10, Tr11, Tr21, Tr22, Tr23, Tr24, Tr31, Tr32, Tr40, Tr41, Tr42, Tr50, Tr51, Tr52, Tr61, Tr62, Tr63, Tr64, Tr111, Tr311, and Tr622 illustrated in FIGS. 5, 7, 8, 9, 10, and 11 may each be an n-type (n-channel) transistor or a p-type (p-channel) transistor. In such an embodiment, semiconductor layers of the respective switching elements may include one of monocrystalline silicon, polycrystalline silicon, and amorphous silicon oxide. In such an embodiment, the oxide may include (e.g., consist of) at least one of indium, gallium, stannum, and zinc.

FIGS. 12A-12D illustrate waveforms of the first clock signal CLK1 and the control voltage VCT input to the $n^{th}$ stage STGn and waveforms of the voltage CRn of the carry output terminal COT, a voltage V_N1 of the output terminal N1 of the output control unit 503, and a voltage V_N2 of the feedback node N2 provided in the $n^{th}$ stage STGn, according to an exemplary embodiment of the present invention.

Figures 12A, 12B, 12C, 12D:
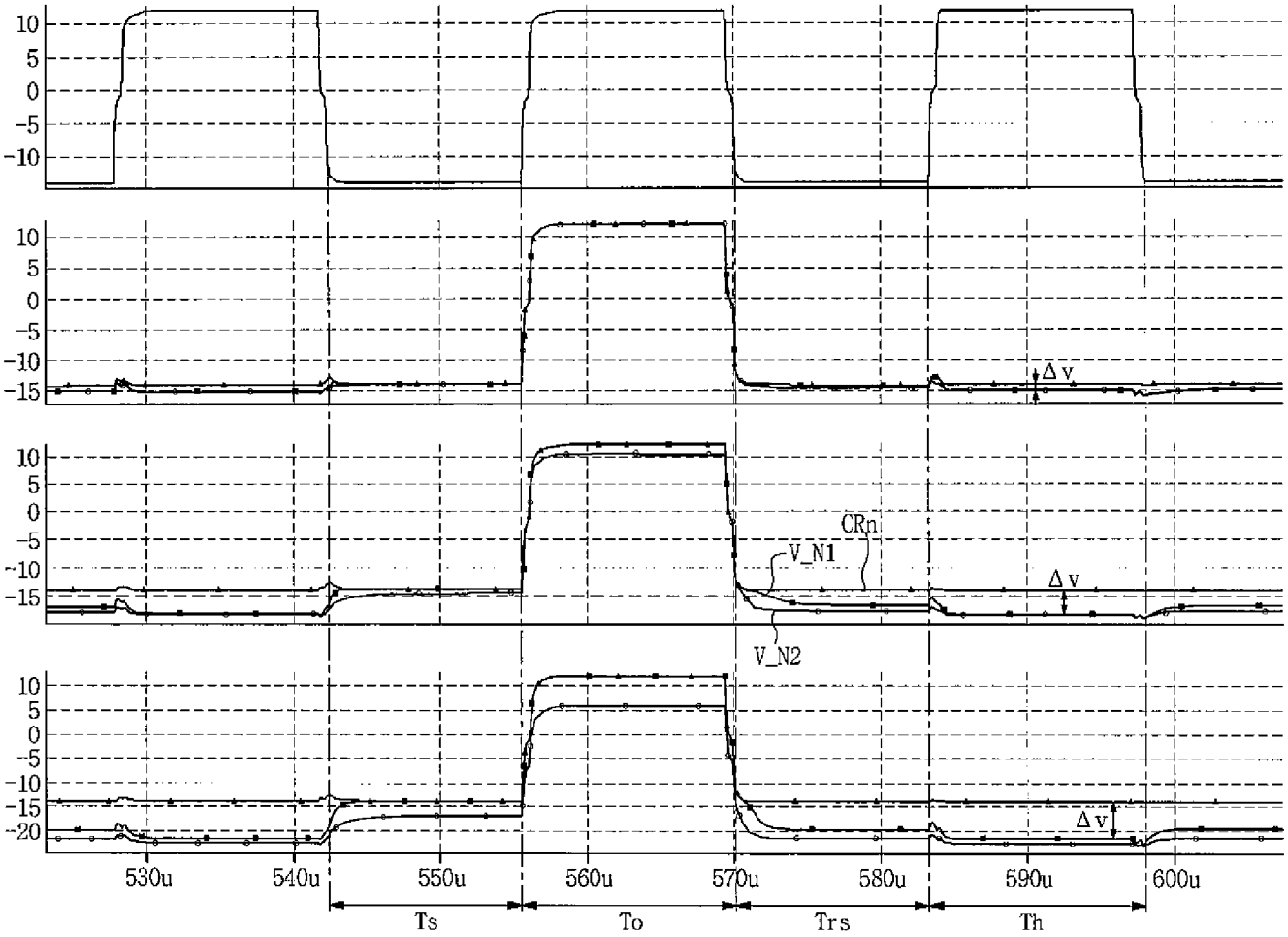
FIGS. 12A-12D illustrate waveforms of a first clock signal and a control voltage input to the $n^{th}$ stage and waveforms of a voltage of a carry output terminal, a voltage of an output terminal of an output control unit, and a voltage of a feedback node in the $n^{th}$ stage, according to an exemplary embodiment of the present invention.

FIG. 12B illustrates the waveform of the voltage CRn of the carry output terminal COT, the waveform of the voltage V_N1 of the output terminal N1, and the waveform of the voltage V_N2 of the feedback node N2 in a case where the control voltage VCT is about −15 V.

FIG. 12C illustrates the waveform of the voltage CRn of the carry output terminal COT, the waveform of the voltage V_N1 of the output terminal N1, and the waveform of the voltage V_N2 of the feedback node N2 in a case where the control voltage VCT is about −19 V.

FIG. 12D illustrates the waveform of the voltage CRn of the carry output terminal COT, the waveform of the voltage V_N1 of the output terminal N1, and the waveform of the voltage V_N2 of the feedback node N2 in a case where the control voltage VCT is about −24 V.

In reference to FIGS. 12A-12C, it is verified that as the control voltage VCT decreases, a difference ΔV between the voltage V_N1 of the output terminal N1 and the voltage CRn of the carry output terminal COT increases. Further, as the difference ΔV increases, the threshold voltage of the carry output switching element Tr50 may further increase, which indicates that the leakage current of the carry output switching element Tr50 may be significantly reduced or prevented by the control voltage VCT in the holding period Th.

As illustrated in FIGS. 12A-12C, the voltage V_N1 of the output terminal N1 and the voltage CRn of the carry output terminal COT may be substantially the same as each other in the output period To. Accordingly, in the output period To in which the driving capability is relatively important, the threshold voltage of the carry output switching element Tr50 is relatively lowered such that the driving capability of the carry output switching element Tr50 is improved. That is, the driving capability of the carry output switching element Tr50 is improved in the output period To rather than that of the holding period Th. On the other hand, the driving capability of the carry output switching element Tr50 is degraded in the holding period Th rather than that of the output period To, which indicates that holding capability of the carry output switching element Tr50 to reduce or prevent the leakage current is improved (e.g., increased) in the holding period Th.

As set forth hereinabove, the display device according to the present invention may have the following effects.

First, a control voltage having different levels based on an amount of current generated from the shift register is applied to the switching elements. The control voltage weakens an increasing tendency or a decreasing tendency of the threshold voltage of the switching elements. Accordingly, the threshold voltage of the switching elements may be stabilized.

Second, while a clock signal having a high voltage level is applied to the sub-gate electrode of the output switching element in the output period, a control voltage having a low voltage level is applied to the sub-gate electrode of the output switching element in the holding period. Accordingly, while the driving capability of the output switching element is improved in the output period, the holding capability of the output switching element is improved in the holding period. Accordingly, a gate signal and a carry signal are normally generated in the output period, and a leakage current may be significantly reduced in the holding period.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when an element is referred to as being "between" two elements, it can be the only element between the two element, or one or more intervening elements may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

From the foregoing, it will be appreciated that various embodiments in accordance with the present disclosure have been described herein for purposes of illustration, and that various suitable modifications may be made without departing from the scope and spirit of the present teachings. Accordingly, the various embodiments disclosed herein are not intended to be limiting of the true scope and spirit of the present teachings, which are defined by the appended claim and their equivalents. Various features of the above described and other embodiments can be mixed and matched in any suitable manner, to produce further embodiments consistent with the invention.

What is claimed is:

1. A display device comprising:

a display panel comprising a gate line operated by a gate signal;

a clock source configured to apply a clock signal;

a shift register comprising a stage, the stage comprising at least one switching element and being configured to generate the gate signal based on the clock signal applied from the clock source; and a control-voltage generator configured to generate a control voltage based on a current generated from at least one of the shift register and the clock source, and to apply the control voltage to the at least one switching element.

2. The display device of claim 1, wherein the control-voltage generator is configured to adjust a level of the control voltage based on a level of the current.

3. The display device of claim 2, wherein the control-voltage generator is configured to adjust the level of the control voltage based on a level of the current accumulated for at least a single frame period.

4. The display device of claim 1, wherein the clock source comprises:

an on-voltage generator configured to generate an on voltage; and a clock generator configured to generate the clock signal based on the on voltage and the off voltage.

5. The display device of claim 4, wherein the control-voltage generator comprises:

a current detector configured to detect a current between an output terminal of the on-voltage generator and an input terminal of the clock generator; and a control-voltage selector configured to select the control voltage based on a detect voltage corresponding to the current detected by the current detector and to output the selected control voltage to a sub-gate electrode of the at least one switching element.

6. The display device of claim 5, wherein the control-voltage generator further comprises an integrator configured to generate the detect voltage by integrating the current applied from the current detector over a period and to apply the detect voltage to the control-voltage selector.

7. The display device of claim 6, wherein the control-voltage generator further comprises an analog-digital converter configured to convert the detect voltage applied from the integrator into a digital signal and to apply the converted digital signal to the control-voltage selector.

8. The display device of claim 1, wherein the at least one switching element comprises:

a source electrode or a drain electrode to which an off voltage that is a direct-current ("DC") voltage is applied; and a sub-gate electrode to which the control voltage is applied.

9. The display device of claim 8, wherein the at least one switching element comprises at least one selected from:

a first inverter switching element comprising a gate electrode connected to an output terminal of the stage and a sub-gate electrode to which the control voltage is applied, the first inverter switching element being connected between an inverter node of the stage and an off-voltage input terminal of the stage;

a second inverter switching element comprising a gate electrode connected to the output terminal of the stage and a sub-gate electrode to which the control voltage is applied, the second inverter switching element being connected between a reset node of the stage and the off-voltage input terminal of the stage;

a reset switching element comprising a gate electrode connected to a reset control terminal of the stage and a sub-gate electrode to which the control voltage is applied, the reset switching element being connected between a set node of the stage and the off-voltage input terminal of the stage;

a first output discharge switching element comprising a gate electrode connected to the reset node of the stage and a sub-gate electrode to which the control voltage is applied, the first output discharge switching element being connected between the output terminal of the stage and the off-voltage input terminal of the stage; and a second output discharge switching element comprising a gate electrode connected to the reset control terminal of the stage and a sub-gate electrode to which the control voltage is applied, the second output discharge switching element being connected between the output terminal of the stage and the off-voltage input terminal of the stage.

10. The display device of claim 9, wherein the output terminal of the stage is one of a gate output terminal through which the gate signal is output and a carry output terminal through which a carry signal is output, and wherein the off-voltage input terminal of the stage is one of a first off-voltage input terminal to which a first off voltage is applied and a second off-voltage input terminal to which a second off voltage is applied.

11. The display device of claim 10, wherein the first off voltage has a level lower than that of the second off voltage, and wherein the control voltage has a level lower than that of the first off voltage.

12. The display device of claim 1, wherein the stage further comprises an output controller configured to select one of the clock signal and the control voltage based on a select control signal and to apply the selected one of the clock signal and the control voltage to at least another switching element.

13. The display device of claim 12, wherein the select control signal comprises at least two selected from: a voltage of a set node, a voltage of a reset node, and an inverse clock signal, the inverse clock signal being an inverse of the clock signal.

14. The display device of claim 13, wherein the output controller comprises:

a first control switching element comprising a gate electrode connected to the set node of the stage, the first control switching element being connected between a first clock input terminal of the stage and a sub-gate electrode of the at least another switching element; and a second control switching element comprising a gate electrode connected to one of the reset node of the stage and a second clock input terminal of the stage, the second control switching element connected between the sub-gate electrode of the at least another switching element and a control terminal of the stage.

15. The display device of claim 14, wherein the output controller further comprises a third control switching element comprising a gate electrode connected to the reset node, the third control switching element being connected between the first control switching element and the second control switching element.

16. The display device of claim 15, wherein the output controller further comprises a fourth control switching element comprising a gate electrode connected to the set node, the fourth control switching element being connected between a node between the second control switching element and the third control switching element and the first clock input terminal.

17. The display device of claim 14, wherein the output controller further comprises a capacitor connected between the sub-gate electrode of the at least another switching element and a first off-voltage input terminal of the stage.

18. The display device of claim 12, wherein the at least another switching element comprises at least one selected from:

a gate output switching element comprising a gate electrode connected to a set node of the stage and a sub-gate electrode to which the output selected by the output controller is applied, the gate output switching element being connected between a clock input terminal of the stage and a gate output terminal of the stage;

a carry output switching element comprising a gate electrode connected to the set node and a sub-gate electrode to which the output selected by the output controller is applied, the carry output switching element being connected between the clock input terminal and a carry output terminal of the stage; and a set switching element comprising a gate electrode connected to a set control terminal of the stage and a sub-gate electrode to which the output selected by the output controller is applied, the set switching element being connected between the set control terminal and the set node.

* * * * *